US012433470B2

(12) United States Patent
Büsing et al.

(10) Patent No.: US 12,433,470 B2
(45) Date of Patent: Oct. 7, 2025

(54) DRAIN ASSEMBLY AND HOME APPLIANCE

(71) Applicant: SAMSUNG ELECTRONICS CO., LTD., Suwon-si (KR)

(72) Inventors: Johannes Büsing, Suwon-si (KR); Sangjune Lee, Suwon-si (KR); Sungjin Kim, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 151 days.

(21) Appl. No.: 18/137,794

(22) Filed: Apr. 21, 2023

(65) Prior Publication Data

US 2024/0000290 A1 Jan. 4, 2024

Related U.S. Application Data

(63) Continuation of application No. PCT/KR2023/004732, filed on Apr. 7, 2023.

(30) Foreign Application Priority Data

Jun. 30, 2022 (KR) ..... 10-2022-0080952

(51) Int. Cl.
*A47L 15/42* (2006.01)

(52) U.S. Cl.
CPC ..... *A47L 15/4225* (2013.01); *A47L 15/4223* (2013.01)

(58) Field of Classification Search
CPC . D06F 39/085; A47L 15/4223; A47L 15/4225
See application file for complete search history.

(56) References Cited

U.S. PATENT DOCUMENTS 6,398,495 B1 6/2002 Kazianus
8,012,268 B2 9/2011 Yoon et al.
(Continued)

FOREIGN PATENT DOCUMENTS

CN 108223393 A 6/2018
CN 212140378 U 12/2020
(Continued)

OTHER PUBLICATIONS

International Search Report dated Jul. 25, 2023 in International Patent Application No. PCT/KR2023/004732.
(Continued)

*Primary Examiner* — David G Cormier
(74) *Attorney, Agent, or Firm* — STAAS & HALSEY LLP

(57) ABSTRACT

A dishwasher comprising a tub; a drain port including a port body, a first port coupling portion extending along an edge of an outer circumferential surface of the port body, and a second port coupling portion extending along an edge of an outer circumferential surface of the port body, the second port coupling portion having a length longer than a length of the first port coupling portion; and a drain pump, to be coupleable to and decouplable from the drain port. The drain pump includes: a first pump coupling portion to allow the drain pump to couple to and decouple from the first port coupling portion; a second pump coupling portion to allow the drain pump to couple to and decouple from the second port coupling portion; and an interfering rib to interfere with the second port coupling portion to thereby prevent the first pump coupling portion from being coupled to the second port coupling portion or prevent the second pump coupling portion from being coupled to the first port coupling portion.

15 Claims, 28 Drawing Sheets

(56) References Cited

U.S. PATENT DOCUMENTS

| | | | | |
|---|---|---|---|---|
| 10,718,081 | B2 | 7/2020 | Choi et al. | |
| 10,820,778 | B2 | 11/2020 | Lee et al. | |
| 11,324,381 | B2 | 5/2022 | Büsing et al. | |
| 11,560,895 | B2 | 1/2023 | Choi et al. | |
| 2017/0298960 | A1 | 10/2017 | Li et al. | |
| 2020/0385914 | A1* | 12/2020 | Choi | D06F 39/085 |

FOREIGN PATENT DOCUMENTS

| | | | |
|---|---|---|---|
| CN | 215534124 | U | 1/2022 |
| JP | 6570299 | | 9/2019 |
| KR | 10-2006-0025341 | | 3/2006 |
| KR | 10-0608880 | | 8/2006 |
| KR | 10-2011-0132942 | | 12/2011 |
| KR | 10-2012-0005869 | | 1/2012 |
| KR | 10-2017-0140701 | | 12/2017 |
| KR | 10-2019-0065828 | | 6/2019 |
| KR | 10-2020-0072297 | | 6/2020 |
| KR | 10-2352392 | | 1/2022 |

OTHER PUBLICATIONS

PCT/ISA/237 dated Jul. 25, 2023 in International Patent Application No. PCT/KR2023/004732.
Extended European Search Report dated May 27, 2025, in European Application No. EP 23 83 1685.

* cited by examiner

DRAIN ASSEMBLY AND HOME APPLIANCE

CROSS-REFERENCE TO RELATED APPLICATION

This application is a continuation application, under 35 U.S.C. § 111(a), of international application No. PCT/KR2023/004732, filed on Apr. 7, 2023, which claims priority under 35 U. S. C. § 119 to Korean Patent Application No. 10-2022-0080952, filed Jun. 30, 2022, the disclosures of which are incorporated herein by reference in their entirety.

BACKGROUND

Field

The disclosure relates to a drain assembly having an improved structure, and a home appliance.

Discussion of Related Art

A home appliance may include a drain assembly for draining water. For example, home appliances having drain assemblies include a dishwasher for washing dishes, a washing machine for washing clothes, etc.

In general, a drain assembly includes a drain port and a drain pump connected to the drain port to generate a pumping force. For example, a dishwasher may include a drain port communicating with a sump and a drain pump connected to the drain port to drain water and/or foreign materials (for example, food waste, etc.) in the sump to the outside after washing of dishes is finished.

Meanwhile, in the case in which the drain pump is mis-assembled with the drain port, water may leak out. As a result, the performance of the dishwasher deteriorates, and an accident, such as an electric shock or a fire, may occur.

Also, in the case in which a component for fixing the drain pump to the drain port is provided in the upper portion of the drain pump, the component may interfere with other components of the home appliance upon installing/separating of the drain pump in/from the drain port. That is, there may be difficulties in maintaining and repairing the drain pump.

SUMMARY

A dishwasher including: a tub forming a washing room; a drain port including a port body, a first port coupling portion extending along an edge of an outer circumferential surface of the port body, and a second port coupling portion extending along the edge of the outer circumferential surface of the port body, the second port coupling portion having a length longer than a length of the first port coupling portion, and a drain pump, to be coupleable to and decouplable from the drain port, and while the drain pump is coupled to the drain port, to generate a pumping force to drain water from the washing room of the tub that flows through the drain port to an outside of the dishwasher. The drain pump includes: a first pump coupling portion to allow the drain pump to couple to and decouple from the first port coupling portion of the drain port; a second pump coupling portion to allow the drain pump to couple to and decouple from to the second port coupling portion of the drain port; and an interfering rib to interfere with the second port coupling portion of the drain port as the drain port and the drain pump are being coupled to each other to thereby prevent the first pump coupling portion of the drain pump from being coupled to the second port coupling portion of the drain port or prevent the second pump coupling portion of the drain pump from being coupled to the first port coupling portion of the drain port.

The first pump coupling portion of the drain pump may rotate along a circumferential direction of and outside an edge surface of the first port coupling portion of the drain port. The second pump coupling portion of the drain pump may rotate along the circumferential direction of and outside an edge surface of the second port coupling portion of the drain port.

The first pump coupling portion of the drain pump and the second pump coupling portion of the drain pump may be in a shape of point symmetry with respect to a rotation axis of the drain pump.

The drain pump may be coupled to the drain port by rotating the first pump coupling portion of the drain pump in one direction along an edge of the first port coupling portion of the drain port and rotating the second pump coupling portion of the drain pump in the one direction along an edge of the second port coupling portion of the drain port.

The drain pump may include: a first stopper configured to be in contact with the first port coupling portion of the drain port, in a state in which the drain pump is coupled to the drain port, and limit a rotation of the first pump coupling portion of the drain pump in the one direction; and a second stopper configured to be in contact with the second port coupling portion of the drain port, in the state in which the drain pump is coupled to the drain port, and limit a rotation of the second pump coupling portion of the drain pump in the one direction.

The drain pump may be movable between a first position at which the drain pump is inserted in the drain port and a second position at which the drain pump is coupled to the drain port by rotating in one direction while the drain pump is at the first position.

The drain port may further include a locking portion formed in a lower portion of the port body. The drain pump may further include a hooking protrusion that is in contact with the locking portion in a state in which the drain pump is located at the second position.

The dishwasher may further include: a base frame positioned below the tub and configured to accommodate the drain port and the drain pump; an opening formed at a bottom of the base frame; and a cover configured to open and close the opening.

The opening may allow the hooking protrusion of the drain pump and the locking portion of the drain port to be accessed through the opening.

The locking portion of the drain port may be positioned toward the bottom of the base frame.

The first pump coupling portion of the drain pump may include: a first groove open toward an end of the first port coupling portion of the drain port in a state in which the drain pump is located at the first position, a width of the first groove being a first width; and a second groove extending from the first groove and to accommodate the first port coupling portion of the drain port in a state in which the drain pump is located at the second position, a width of the second groove being a second width that is smaller than the first width.

The second pump coupling portion of the drain pump may include: a first groove open toward an end of the second port coupling portion of the drain port in a state in which the drain pump is located at the first position, a width of the first groove being a first width; and a second groove extending from the first groove and to accommodate the second port coupling portion of the drain port in a state in which the drain pump is located at the second position, a width of the second groove being a second width that is smaller than the first width.

While the drain pump is located at the second position, the interfering rib may be located above the first pump coupling portion of the drain pump and the second pump coupling portion of the drain pump.

While the drain pump is located at the second position, the hooking protrusion may be located below the first pump coupling portion of the drain pump and the second pump coupling portion of the drain pump.

The drain pump may include: a drain motor; an impeller connectable to the drain motor and configured to rotate; and a case to accommodate the drain motor, and the case including the first pump coupling portion of the drain pump, the second pump coupling portion of the drain pump, and the interfering rib.

A drain assembly including: a drain portion including a port body, a first port coupling portion formed along an edge of an outer circumferential surface of the port body, and a second port coupling portion formed along the edge of the outer circumferential surface of the port body, the second port coupling portion having a length longer than a length of the first port coupling portion; and a drain pump coupleable to and decouplable from the drain port and configured to pump water of the port body. The drain pump may include a first pump coupling portion configured to allow the drain pump to couple to and decouple from the first port coupling portion of the drain port by rotating along an edge surface of the first port coupling portion, and a second pump coupling portion configured to allow the drain pump to couple to and decouple from the second port coupling portion of the drain port by rotating along an edge surface of the second port coupling portion.

The drain pump may further include an interfering rib configured to interfere with the second port coupling portion of the drain port and to prevent the first pump coupling portion of the drain pump from being coupled to the second port coupling portion of the drain port or prevent the second pump coupling portion of the drain pump from being coupled to the first port coupling portion of the drain port.

The drain pump may include: a first stopper configured to limit a rotation of the first pump coupling portion of the drain pump in a state in which the drain pump is coupled to the drain port; and a second stopper configured to limit a rotation of the second pump coupling portion of the drain pump in the state in which the drain pump is coupled to the drain port.

The drain port may further include a locking portion protruding downward. The drain pump may further include a hooking protrusion that may be fixed to the locking portion.

The port body may have a hollow shape. The first pump coupling portion of the drain pump and the second pump coupling portion of the drain pump may protrude in a radial direction from an outer surface of the port body.

BRIEF DESCRIPTION OF THE DRAWINGS

The above and other objects, features and advantages of the present disclosure will become more apparent to those of ordinary skill in the art by describing in detail exemplary embodiments thereof with reference to the accompanying drawings, in which.

DETAILED DESCRIPTION OF EXEMPLARY EMBODIMENTS

Figure 1:
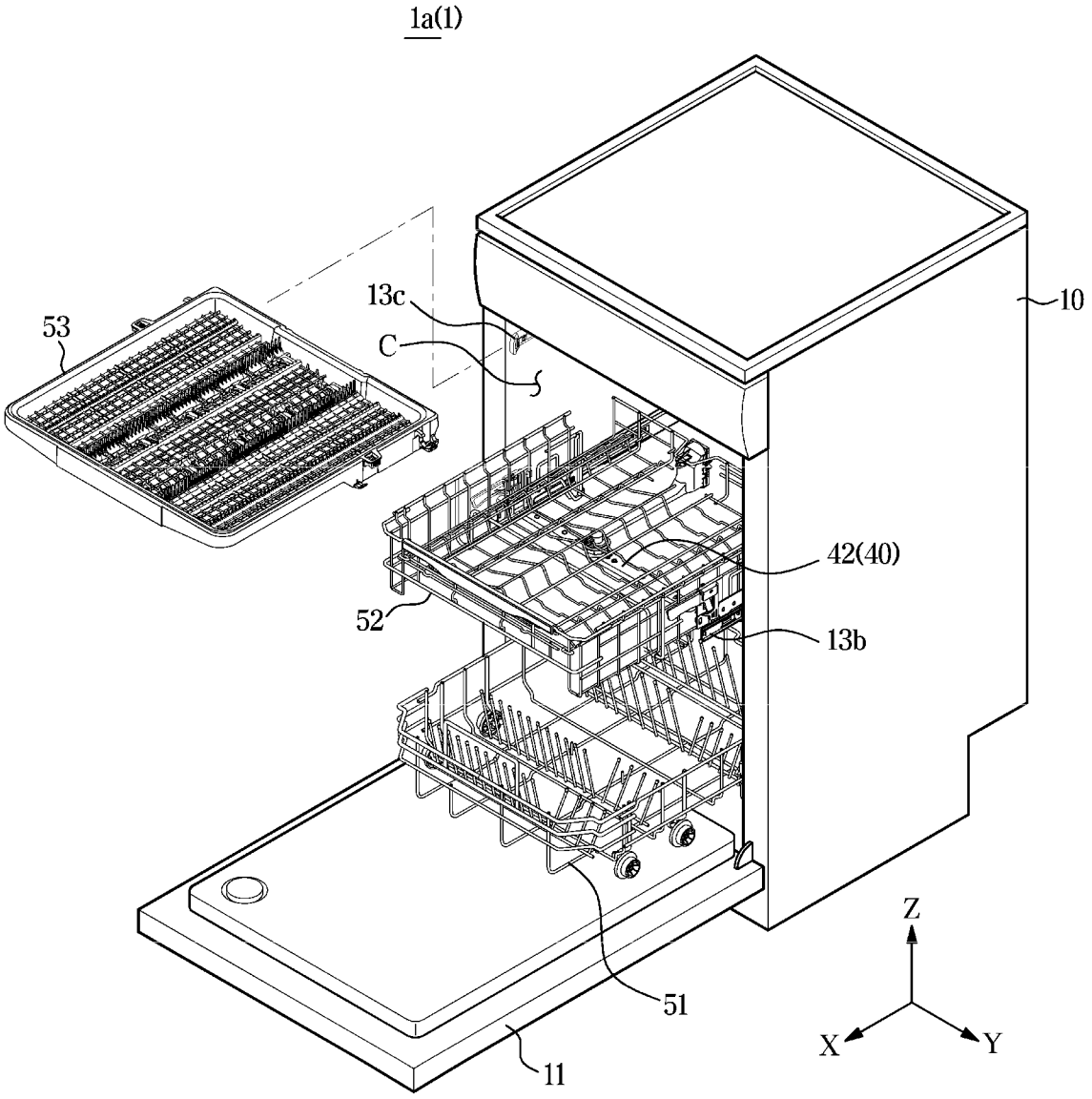
FIG. 1 is a schematic perspective view of a dishwasher according to an embodiment of the disclosure.

Configurations illustrated in the embodiments and the drawings described in the present specification are only the preferred embodiments of the present disclosure, and thus it is to be understood that various modified examples, which may replace the embodiments and the drawings described in the present specification, are possible.

Also, like reference numerals or symbols denoted in the drawings of the present specification represent members or components that perform the substantially same functions.

Also, the terms used in the present specification are merely used to describe the embodiments, and are not intended to limit and/or restrict the disclosure. An expression used in the singular encompasses the expression of the plural, unless it has a clearly different meaning in the context. In the present specification, it is to be understood that the terms such as "comprising", "including" or "having", etc., are intended to indicate the existence of the features, numbers, steps, operations, components, parts, or combinations thereof disclosed in the specification, and are not intended to preclude the possibility that one or more other features, numbers, steps, operations, components, parts, or combinations thereof may exist or may be added.

Throughout this specification, it will be understood that when a certain part is referred to as being "connected" to another part, it can be directly or indirectly connected to the other part. Likewise, it will be understood that when a certain part is referred to as being "coupled" to another part, it can be directly or indirectly coupled to the other part.

In the entire specification, it will also be understood that when an element is referred to as being "on" or "over" another element, it can be directly on the other element or intervening elements may also be present.

Also, it will be understood that, although the terms including ordinal numbers, such as "first", "second", etc., may be used herein to describe various components, these components should not be limited by these terms. These terms are only used to distinguish one component from another. For example, a first component could be termed a second component, and, similarly, a second component could be termed a first component, without departing from the scope of the present disclosure. As used herein, the term "and/or" includes any and all combinations of one or more of associated listed items.

Meanwhile, in the following description, the terms "front-rear direction", "front direction", "rear direction", "upper side", "lower side", etc. are defined based on the drawings, and the shapes and positions of the components are not limited by the terms.

Figure 2:
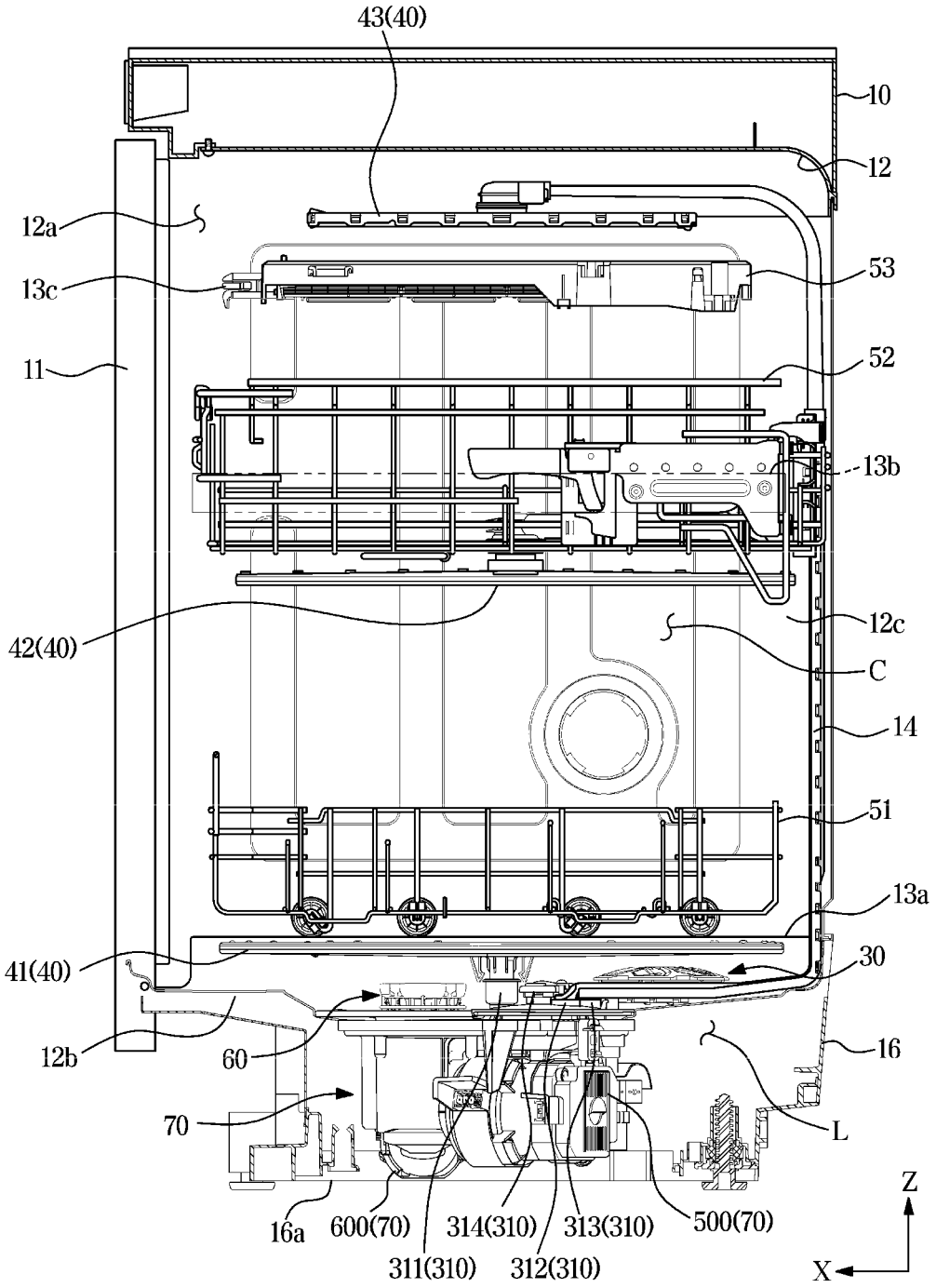
FIG. 2 is a schematic side cross-sectional view of a dishwasher according to an embodiment of the disclosure.

For example, referring to FIGS. 1 and 2, a "up-down direction", a "height direction", and a "vertical direction" may be a Z direction. A "horizontal direction" may be all directions on a X-Y plane. However, the above-described content is an example, and the disclosure is not limited to this.

An aspect of the disclosure provides a drain assembly having an improved structure, and a home appliance.

An aspect of the disclosure provides a drain assembly capable of preventing mis-assembling of a drain pump, and a home appliance.

An aspect of the disclosure provides a drain assembly having improved assembling performance of a drain pump, and a home appliance.

An aspect of the disclosure provides a drain assembly capable of easily maintaining and repairing a drain pump, and a home appliance.

According to an aspect of the disclosure, the drain assembly and the home appliance may have an improved coupling structure of the drain pump.

According to an aspect of the disclosure, the drain assembly and the home appliance may prevent mis-assembling of the drain pump.

According to an aspect of the disclosure, the drain assembly and the home appliance may easily maintain and repair the drain pump.

Hereinafter, an embodiment of the disclosure will be described in detail with reference to the accompanying drawings.

Figure 27:
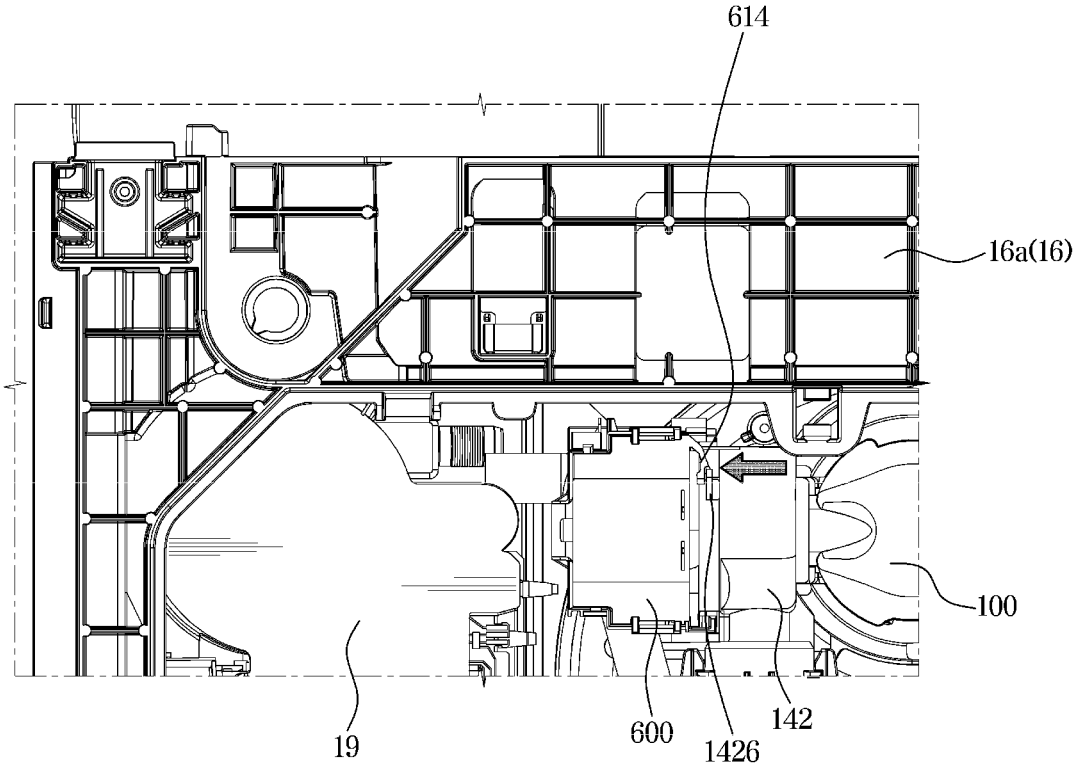
FIG. 27 is an enlarged view of a part of FIG. 26 according to an embodiment of the disclosure.
Figure 28:
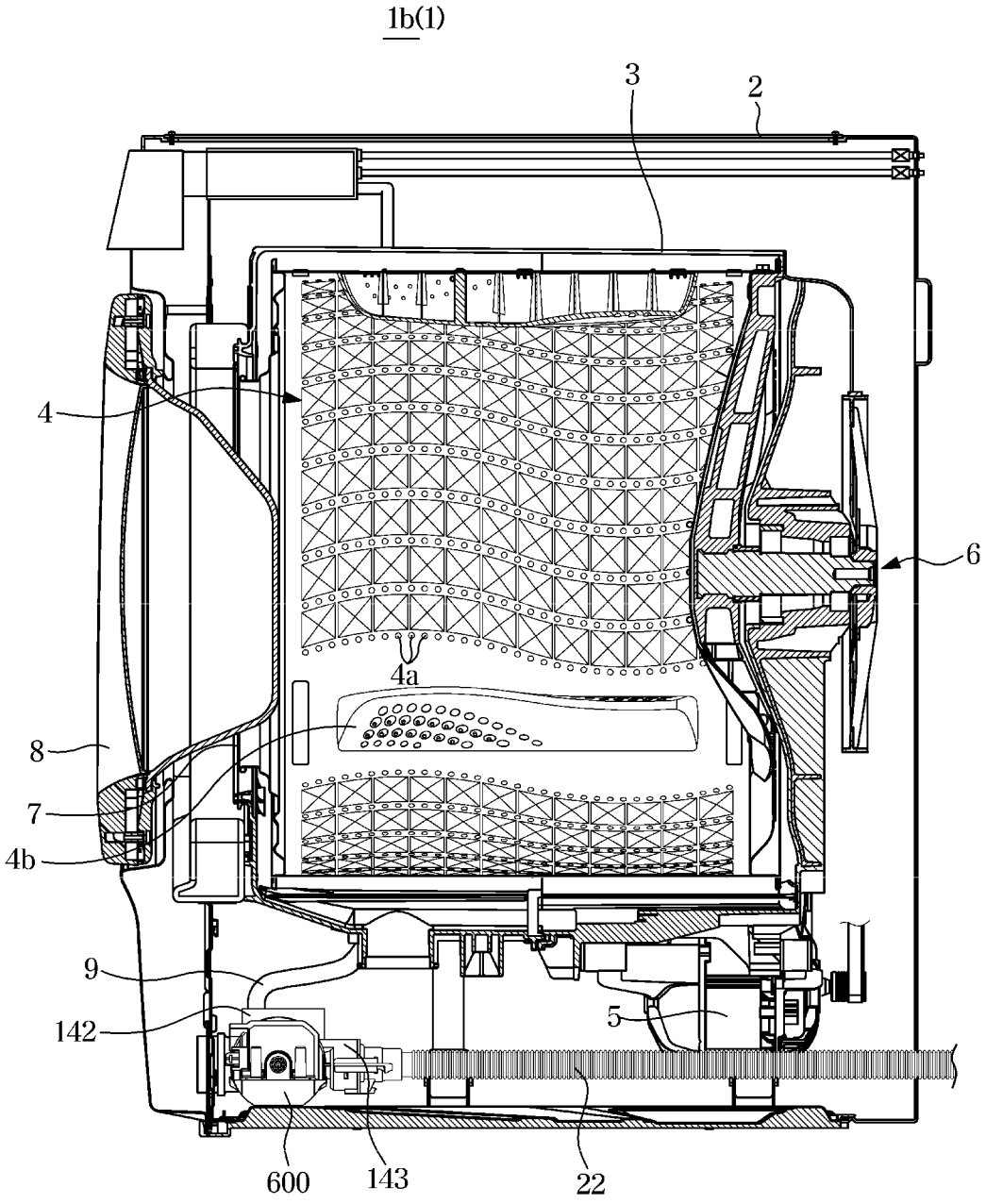
FIG. 28 is a schematic side cross-sectional view of a dishwasher according to an embodiment of the disclosure.

The disclosure relates to a drain assembly and a home appliance 1 having the drain assembly. The home appliance 1 may include a dishwasher, a washing machine, etc. In FIGS. 1 to 27, a dishwasher will be described as an example Ta. In FIG. 28, a washing machine will be described as an example 1*b*. However, the home appliance 1 is not limited to these, and the drain assembly according to the disclosure may be applied to all home appliances having a drain function. For example, the drain assembly may also be applied to an outdoor unit, an indoor unit, a humidifier, a dryer, etc. in view of discharging water remaining in a main body to the outside.

FIG. 1 is a schematic perspective view of a dishwasher according to an embodiment of the disclosure. FIG. 2 is a schematic side cross-sectional view of a dishwasher according to an embodiment of the disclosure.

Referring to FIGS. 1 and 2, the dishwasher 1*a* may include a main body 10. The main body 10 may form an outer appearance of the dishwasher 1*a*.

The dishwasher 1*a* may include a tub 12 provided inside the main body 10. The tub 12 may be substantially in a shape of a box. One side of the tub 12 may open. That is, the tub 12 may have an opening 12*a*. For example, a front side of the tub 12 may open.

The dishwasher 1*a* may include a door 11 configured to open and close the opening 12*a* of the tub 12. The door 11 may be mounted on the main body 10 to open and close the opening 12*a* of the tub 12. The door 11 may be rotatably mounted on the main body 10. The door 11 may be detachably mounted on the main body 10.

The dishwasher 1*a* may further include a storage container provided inside the tub 12 to accommodate dishes.

The storage container may include a plurality of baskets 51, 52, and 53. The plurality of baskets 51, 52, and 53 may accommodate various dishes, although not limited thereto, and the storage container may include a single basket.

The storage container may include a middle basket 52 located at a middle position in a height direction Z of the dishwasher 1*a*, and a lower basket 51 located at a lower position in the height direction Z of the dishwasher 1*a*. The middle basket 52 may be supported by a middle guide rack 13*b*. The lower basket 51 may be supported by a lower guide rack 13*a*. The middle guide rack 13*b* and the lower guide lack 13*a* may be installed on a side surface 12*c* of the tub 12 to allow sliding toward the opening 12*a* of the tub 12. The side surface 12*c* of the tub 12 may include an inner surface of a right wall of the tub 12 and/or an inner surface of a left wall of the tub 12.

Dishes having relatively large volumes may be accommodated in the plurality of baskets 51 and 52. However, a kind of dishes that are accommodated in the plurality of baskets 51 and 52 is not limited to dishes having relatively large volumes. That is, dishes having relatively small volumes, as well as dishes having relatively large volumes, may also be accommodated in the plurality of baskets 51 and 52.

The storage container may include an upper basket 53 located at an upper position in the height direction Z of the dishwasher 1*a*. The upper basket 53 may be formed in a shape of a rack assembly to accommodate dishes having relatively small volumes. For example, cutlery and cooking tools, such as a ladle, a knife, a spatula, etc., may be accommodated in the upper basket 53. A small cup such as an espresso cup may be accommodated in the upper basket 53. However, a kind of dishes that are accommodated in the upper basket 53 is not limited to the above-mentioned examples.

The upper basket 53 may be supported by an upper guide rack 13*c*. The upper guide rack 13*c* may be installed on the side surface 13*c* of the tub 12. For example, the upper basket 53 may slide on the upper guide rack 13*c*, and may be put into a washing room C or taken out of the washing room C.

The dishwasher 1*a* may include the washing room C that is a space formed inside the tub 12. The washing room C may be defined as an inside space of the tub 12. The washing room C may be a space where dishes accommodated in the storage container may be washed with water and dried.

The dishwasher 1*a* may include a spraying device 40 for spraying water. The spraying device 40 may spray water to the washing room C. The spraying device 40 may spray water toward the dishes accommodated in the storage container. The spraying device 40 may receive water from a sump assembly 70 which will be described below.

The spraying device 40 may include at least one spraying unit. The spraying device 40 may include a single spraying unit or a plurality of spraying units 41, 42, and 43.

For example, the plurality of spraying units 41, 42, and 43 may include a first spraying unit 41 positioned below the lower basket 51 in the height direction Z of the dishwasher 1*a*, a second spraying unit 42 positioned below the middle basket 52 in the height direction Z of the dishwasher 1*a*, and a third spraying unit 43 positioned above the upper basket 53 in the height direction Z of the dishwasher 1*a*, although not limited thereto. However, the plurality of spraying units 41, 42, and 43 may be two, four, or more.

Each of the plurality of spraying units 41, 42, and 43 may spray water while rotating. Each of the first spraying unit 41, the second spraying unit 42, and the third spraying unit 43 may spray water while rotating. The plurality of spraying units 41, 42, and 43 may also be referred to as a plurality of spraying rotors. The first spraying unit 41, the second spraying unit 42, and the third spraying unit 43 may also be referred to as a first spraying rotor 41, a second spraying rotor 42, and a third spraying rotor 43, respectively.

However, the spraying device 40 may spray water by another method than the above-described example. For example, the first spraying unit 41 may be fixed to a side of a lower surface 12*b* of the tub 12, unlike the second spraying unit 42 and the third spraying unit 43. In this case, the first spraying unit 41 may spray water substantially in a horizontal direction by a fixed nozzle, and the water sprayed substantially in the horizontal direction from the nozzle of the first spraying unit 41 may change in direction by a switching assembly (not shown) positioned inside the washing room C to travel upward. The switching assembly may be installed on a rail (not shown), and perform a translational movement along the rail. Meanwhile, although the first spraying unit 41 has been described as an example, the second spraying unit 42 and the third spraying unit 43 may also spray water by using a fixed nozzle, like the above-described example.

The dishwasher 1*a* may include an auxiliary spraying device 30. The auxiliary spraying device 30 may be positioned at a side of the lower portion of the washing room C to spray water to some area of the washing room C. The auxiliary spraying device 30 may be designed to spray water at relatively higher pressure than the spraying device 40, thereby intensively washing heavily stained dishes. The auxiliary spraying device 30 may be also referred to as an auxiliary spraying unit 30. The auxiliary spraying device 30 may be omitted.

The dishwasher 1*a* may include a sump assembly 70.

The sump assembly 70 may accommodate water. The sump assembly 70 may collect water of the washing room C. For example, for the sump assembly 70 to smoothly collect water, the lower surface 12*b* of the tub 12 may be inclined downward toward the sump assembly 70. Water of the washing room C may smoothly enter the sump assembly 70 by flowing along the inclined lower surface 12*b* of the tub 12.

The dishwasher Ta may include a circulation pump 500 for pumping water stored in the sump assembly 70 to the spraying device 40. The circulation pump 500 may be provided as a component of the sump assembly 70.

For example, the circulation pump 500 may be spaced from a bottom 16*a* of a base frame 16. Accordingly, vibrations generated in the circulation pump 500 may be not transferred to the base frame 16.

The dishwasher Ta may include a drain pump 600 for draining water and/or foreign materials (for example, food waste, etc.) remaining in the sump assembly 70. The drain pump 600 may be provided as a component of the sump assembly 70.

For example, the drain pump 600 may be spaced from the bottom 16*a* of the base frame 16. That is, because the drain pump 600 is in non-contact with the bottom 16*a* of the base frame 16, vibrations generated in the drain pump 600 may be not transferred to the base frame 16. Accordingly, it may be possible to reduce noise of the dishwasher 1 and secure operation stability of the drain pump 600.

The drain pump 600 may be positioned in a horizontal direction in a machine room L. The drain pump 600 may be positioned substantially perpendicularly with respect to the height direction Z of the dishwasher 1*a*. The drain pump 600 may be positioned substantially perpendicularly with respect to the height direction Z of the tub 12. For example, a rotation axis 600*a* of the drain pump 600 may be substantially perpendicular to the height direction Z. For example, the rotation axis 600*a* of the drain pump 600 may intersect the height direction Z. For example, a motor axis of a drain motor 620 (see FIG. 19) of the drain pump 600 may be provided substantially perpendicularly with respect to the height direction Z. For example, the motor axis of the drain motor 620 of the drain motor 600 may intersect the height direction Z. Through the arrangement, a height of the machine room L may be lowered to increase a height of the washing room C. Thereby, a capacity of the washing room C may increase to effectively secure a space of the washing room C.

The sump assembly 70 may pump the collected water and provide the water to the spraying device 40. The sump assembly 70 may pump the collected water and provide the water to the auxiliary spraying device 30. The sump assembly 70 may include a connecting port 310 connected to the spraying device 40 to supply water to the spraying device 40 and/or the auxiliary spraying device 30. For example, the connection port 310 may be formed in a sump cover 300 (see FIG. 3) which will be described below.

For example, referring to FIG. 2, the connecting port 310 may include a first connecting port 311 connected to the first spraying unit 41, a second connecting port 312 connected to the second spraying unit 42, and a third connecting port 313 connected to the third spraying unit 43. The second connecting port 312 may be connected to the second spraying unit 42 by a first duct. The third connecting port 313 may be connected to the third spraying unit 43 by a second duct. The first duct and the second duct may be separate ducts, or a single duct 14, as shown in FIG. 2. The duct 14 may extend in the height direction Z.

For example, the connecting port 310 may include a fourth connecting port 314 connected to the auxiliary spraying device 30. The fourth connecting port 314 may be omitted according to presence or absence of the auxiliary spraying device 30.

The dishwasher 1*a* may include the machine room L that is a space provided below the tub 12. The machine room L may be a space where a component for circulating water is positioned. The dishwasher 1*a* may include the base frame 16 forming the machine room L.

For example, at least one portion of the sump assembly 70 may be positioned in the machine room L. A major portion of the sump assembly 70 may be positioned in the machine room L. That is, an area of the sump assembly 70, positioned in the washing room C, may be smaller than an area of the sump assembly 70, positioned in the machine room L. By reducing the area of the sump assembly 70, occupying the washing room C, an area of the washing room C may be secured. Accordingly, a capacity of the washing room C may increase to improve storage of dishes.

Figure 3:
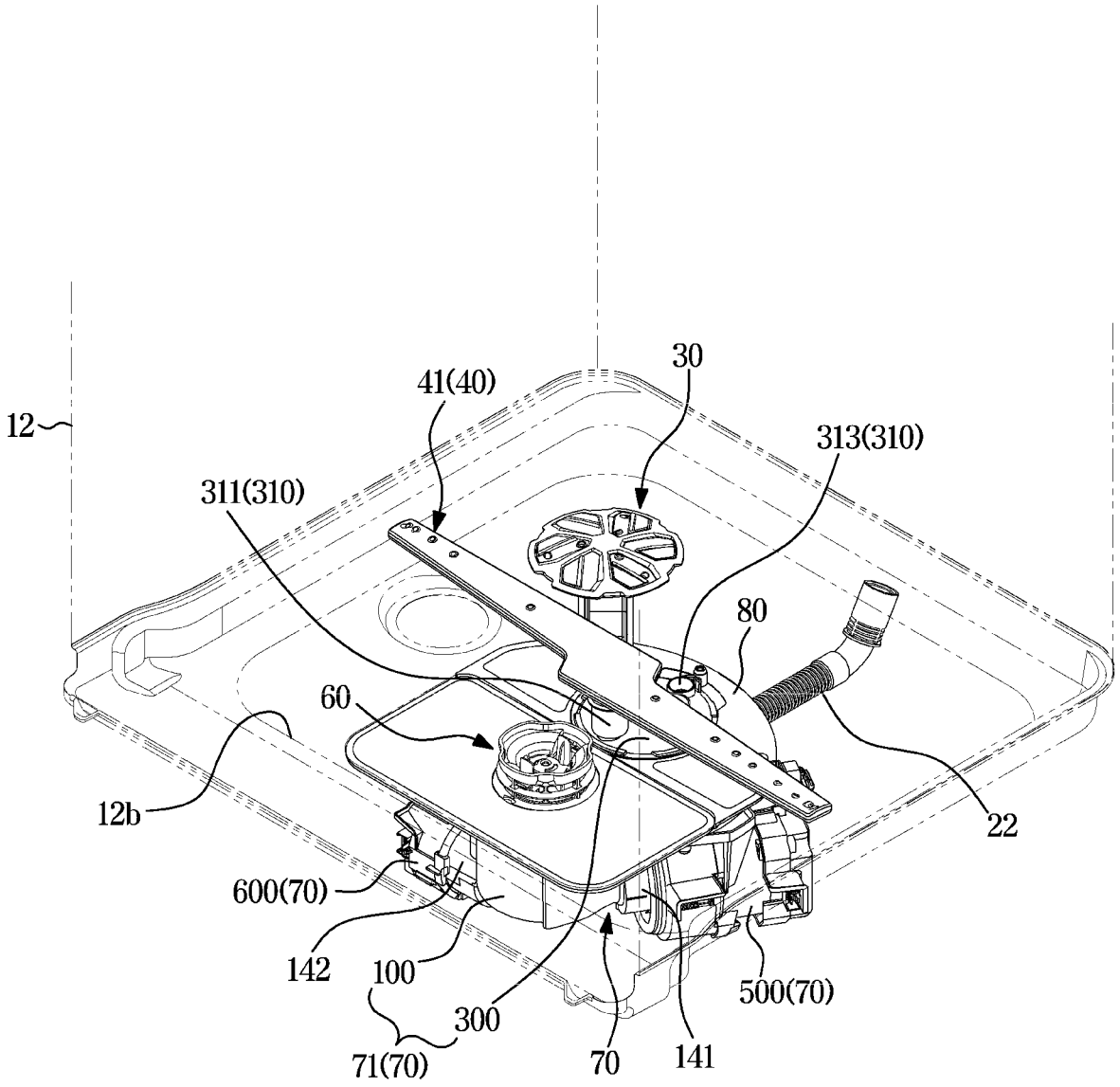
FIG. 3 is a perspective view showing a part of a lower portion of a dishwasher according to an embodiment of the disclosure.

FIG. 3 is a perspective view showing a part of a lower portion of a dishwasher according to an embodiment of the disclosure.

Referring to FIG. 3, the sump assembly 70 may include a sump main body 71. The sump main body 71 may form an outer appearance of the sump assembly 70. Components for collecting, circulating, and supplying water may be detachably installed in the sump main body 71.

For example, the sump main body 71 may include a sump housing 100 and the sump cover 300.

The sump housing 100 may be detachably coupled to the lower surface 12*b* of the tub 12. For example, the sump housing 100 may be screwed to the lower surface 12*b* of the tub 12, although not limited thereto. However, the sump housing 100 may be coupled to the tub 12 by various methods.

The sump cover 300 may cover the sump housing 100. The sump cover 300 may cover a part of an upper portion of the sump housing 100. The sump cover 300 may include the connecting port 310. Water stored in the sump housing 100 may be provided to the spraying device 40 through the connecting port 310 of the sump cover 300.

The dishwasher 1*a* may include the circulation pump 500. The sump assembly 70 may include the circulation pump 500. The circulation pump 500 may pump water stored in the sump housing 100 and transfer the water to the spraying device 40. The circulation pump 500 may be detachably coupled to the sump housing 100. The circulation pump 500 may be detachably coupled to a circulation pump connecting portion 141 of the sump housing 100. The circulation pump 500 may communicate with a water storage chamber 111 (see FIG. 4). The circulation pump 500 may be positioned in the machine room L.

The dishwasher 1*a* may include a drain assembly. For example, the sump assembly 70 of the dishwasher 1*a* may include the drain assembly. The drain assembly may include a drain port 142 and the drain pump 600.

The dishwasher 1*a* may include the drain port 142. The sump assembly 70 may include the drain port 142. Details about this will be described below.

The dishwasher 1*a* may include the drain pump 600. The sump assembly 70 may include the drain pump 600. Details about this will be described below.

The dishwasher 1*a* may include a support frame 80 that may be detachably mounted on the lower surface 12*b* of the tub 12. For example, the support frame 80 may surround an edge of the sump cover 300. For example, the support frame 80 may include a plurality of holes (not shown), and water may be filtered through the plurality of holes.

The support frame 80 may support a filter assembly 60 which will be described below. Meanwhile, the support frame 80 may be referred to as a support plate 80 or a support cover 80.

The dishwasher 1*a* may include the filter assembly 60. The filter assembly 60 may filter out foreign materials included in water entered the sump assembly 70. The filter assembly 60 may be detachably installed in the sump housing 100. The filter assembly 60 may be positioned to correspond to the water storage chamber 111 (see FIG. 4). For example, the filter assembly 60 may include at least one of a fine filter, a coarse filter, or a micro filter.

Water filtered through the filter assembly 60 may be pumped by the circulation pump 500 and provided to the spraying device 40. Accordingly, clean water from which foreign materials have been removed may be sprayed to the washing room C through the spraying device 40.

Figure 4:
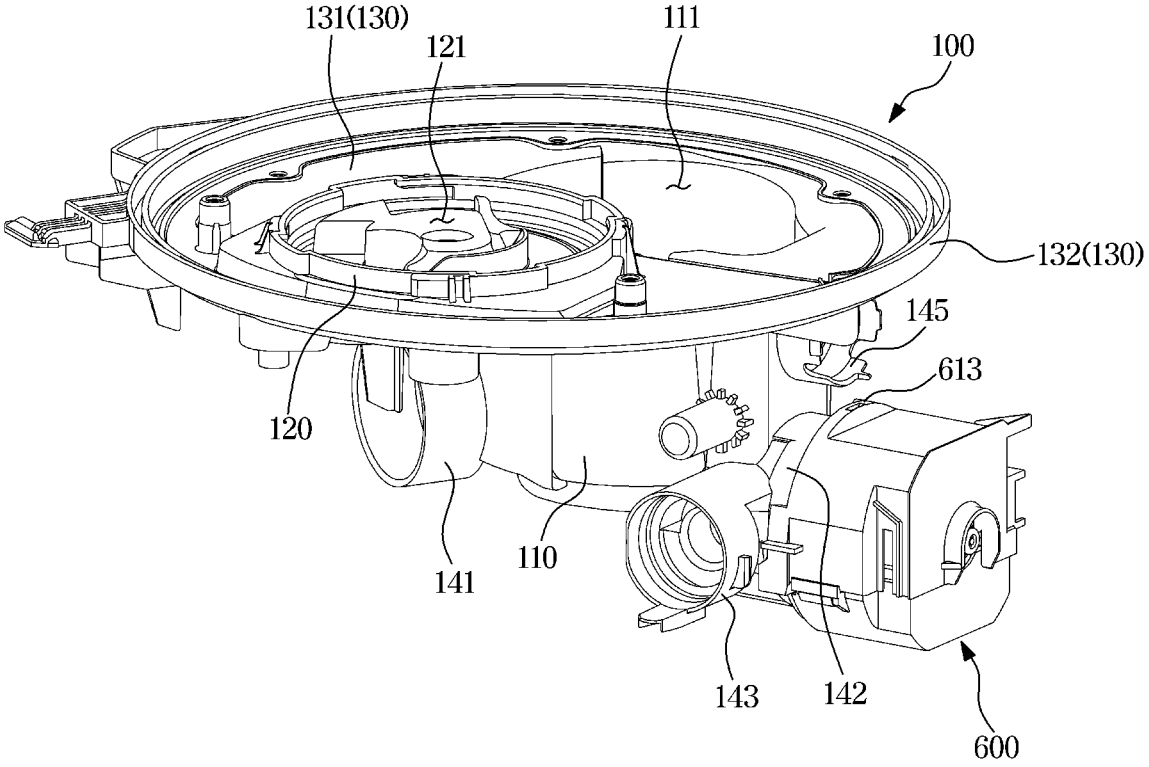
FIG. 4 is a perspective view showing a coupling state of a sump housing and a drain pump of a dishwasher according to an embodiment of the disclosure.
Figure 5:
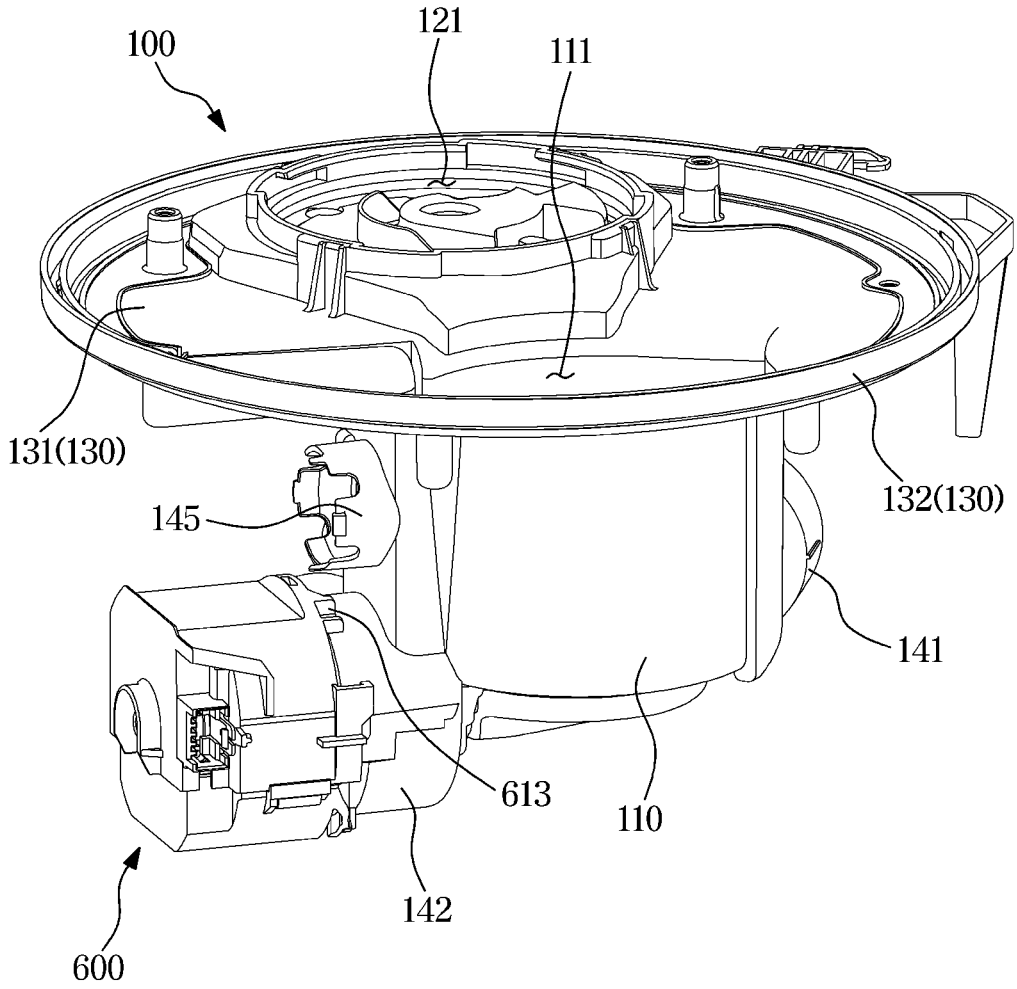
FIG. 5 is a perspective view showing the sump housing and the drain pump shown in FIG. 4, in another direction.
Figure 6:
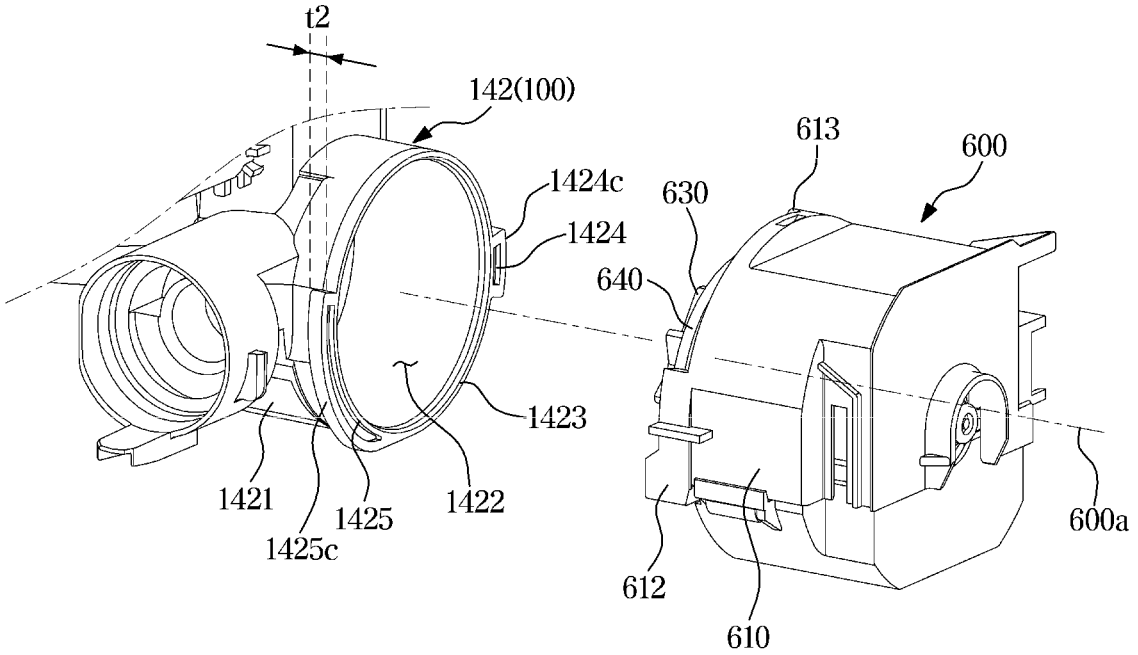
FIG. 6 is an exploded view of a sump housing and a drain pump of a dishwasher according to an embodiment of the disclosure.
Figure 7:
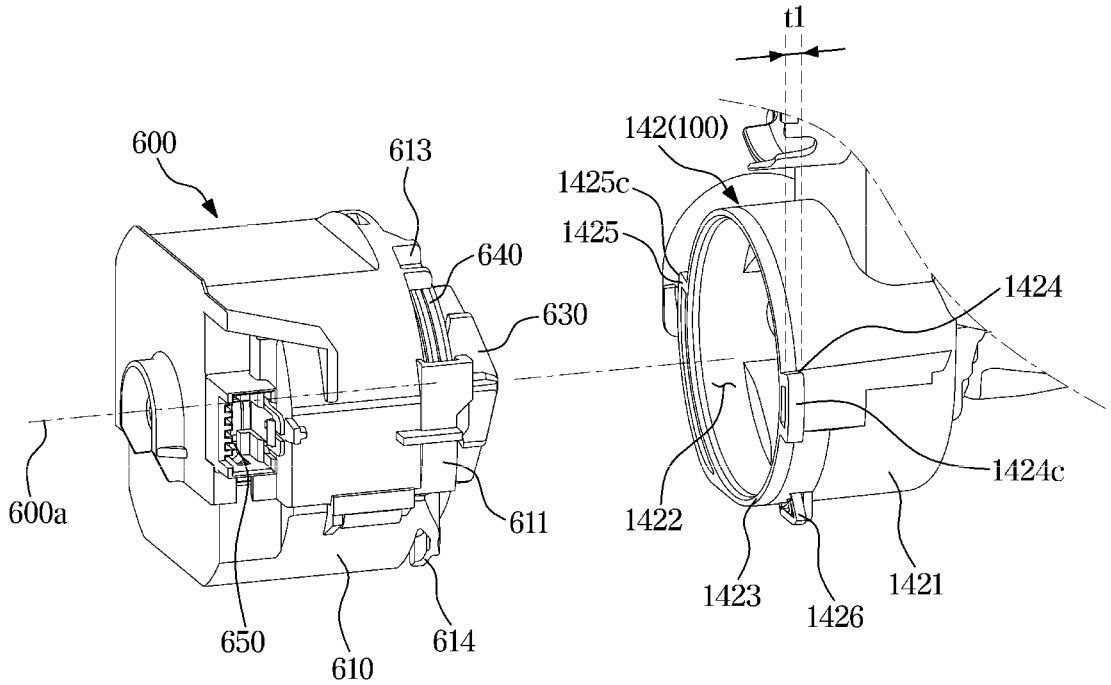
FIG. 7 is an exploded view showing the sump housing and the drain pump shown in FIG. 6, in another direction.

FIG. 4 is a perspective view showing a coupling state of a sump housing and a drain pump of a dishwasher according to an embodiment of the disclosure. FIG. 5 is a perspective view showing the sump housing and the drain pump shown in FIG. 4, in another direction. FIG. 6 is an exploded view of a sump housing and a drain pump of a dishwasher according to an embodiment of the disclosure. FIG. 7 is an exploded view showing the sump housing and the drain pump shown in FIG. 6, in another direction.

Referring to FIGS. 4 to 7, the drain assembly may include the drain port 142 and the drain pump 600 that is connectable to the drain port 142. For example, the drain port 142 may be provided as a component of the sump housing 100. The drain pump 600 may be detachably coupled to the sump housing 100.

The sump housing 100 may include the water storage chamber 111 that stores water. An upper side of the water storage chamber 111 may open. The water storage chamber 111 may accommodate water received from a water supply pipe (not shown), or accommodate water received from the tub 12.

The sump housing 100 may include a distributing chamber 121 in which water to be provided to the spraying device 40 is accommodated. The distributing chamber 121 may be partitioned from the water storage chamber 111. The distributing chamber 121 may receive water stored in the water storage chamber 111.

Water accommodated in the distributing chamber 121 may be distributed to the spraying device 40 through a distributing device (not shown). The distributing device may selectively supply water to the plurality of spraying units 41, 42, and 43. The distributing device may be detachably installed in the sump housing 100. The distributing device may be provided as a component of the sump assembly 70, although not limited thereto. The distributing device may be provided as a separate component from the sump assembly 70.

For example, the sump housing 100 may include a first sump body 110 forming the water storage chamber 111, and a second sump body 120 forming the distributing chamber 121.

For example, the sump housing 100 may include a third sump body 130. The third sump body 130 may be an outer appearance of the sump housing 100, except for the first sump body 110 and the second sump body 120.

For example, the third sump body 130 may include a base portion 131 connecting the first sump body 110 to the second sump body 120. The third sump body 130 may include an edge portion 132 protruding upward from an outer edge of the base portion 131.

The drain port 142 may be a passage 142 through which water and/or foreign materials flow. The drain port 142 may communicate with the water storage chamber 111. For example, water and/or foreign materials remaining in the water storage chamber 111 may flow to the drain port 142. In the drawings, a case in which the drain port 142 is formed in the sump housing 100 of the dishwasher 1*a* is shown, although the disclosure is not limited thereto. The drain port 142 may be provided as a separate component from the sump housing 100. Also, the drain port 142 may be provided as a component of various home appliances 1 except for a dishwasher, not a component of the dishwasher 1*a*.

Meanwhile, the drain port 142 may also be referred to as a drain flange 142 or a drain pump connecting portion 142.

The drain pump 600 may generate a pumping force to drain water. For example, the drain pump 600 may generate a pumping force to drain water and foreign materials stored in the sump housing 100. The drain pump 600 may generate a pumping force to drain water and foreign materials stored in the water storage chamber 111. The drain pump 600 may be detachably coupled to the drain port 142. The drain pump 600 may communicate with the water storage chamber 111 through the drain port 142. The drain pump 600 may be provided as a lowest one of components of the sump assembly 70 for smooth drainage. The drain pump 600 may be positioned in the machine room L.

Figure 8:
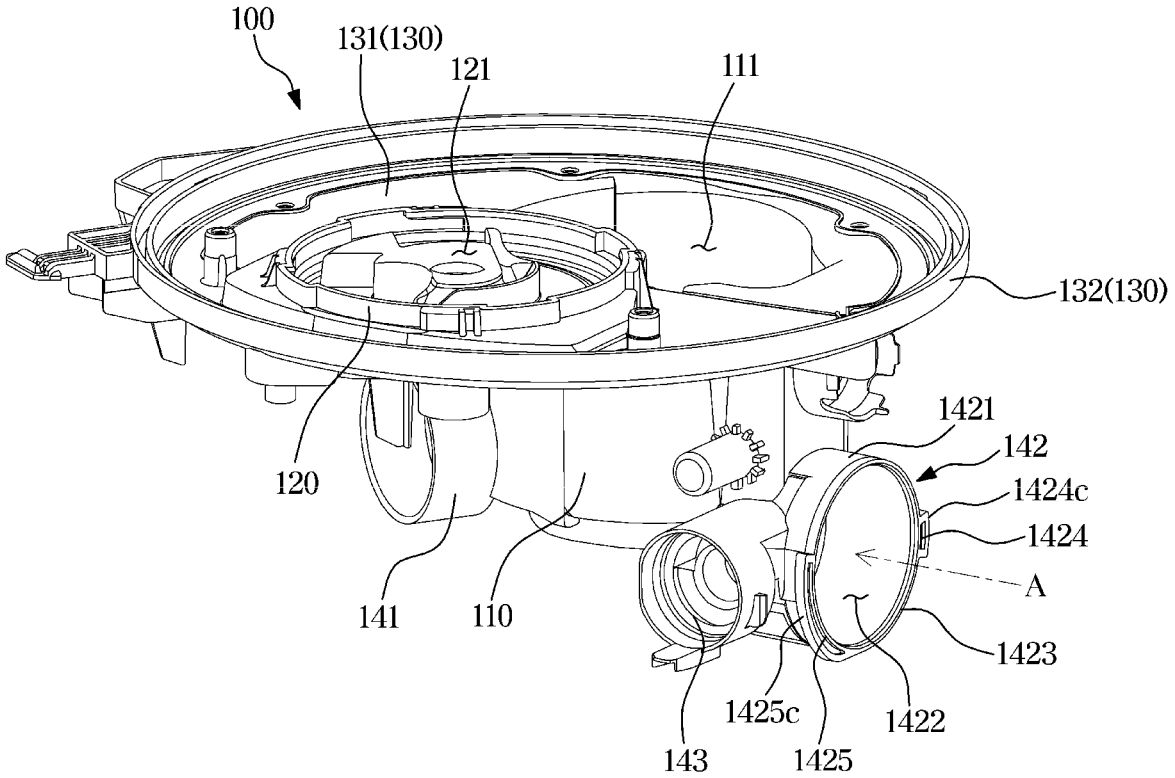
FIG. 8 is a perspective view of a sump housing of a dishwasher according to an embodiment of the disclosure.
Figure 9:
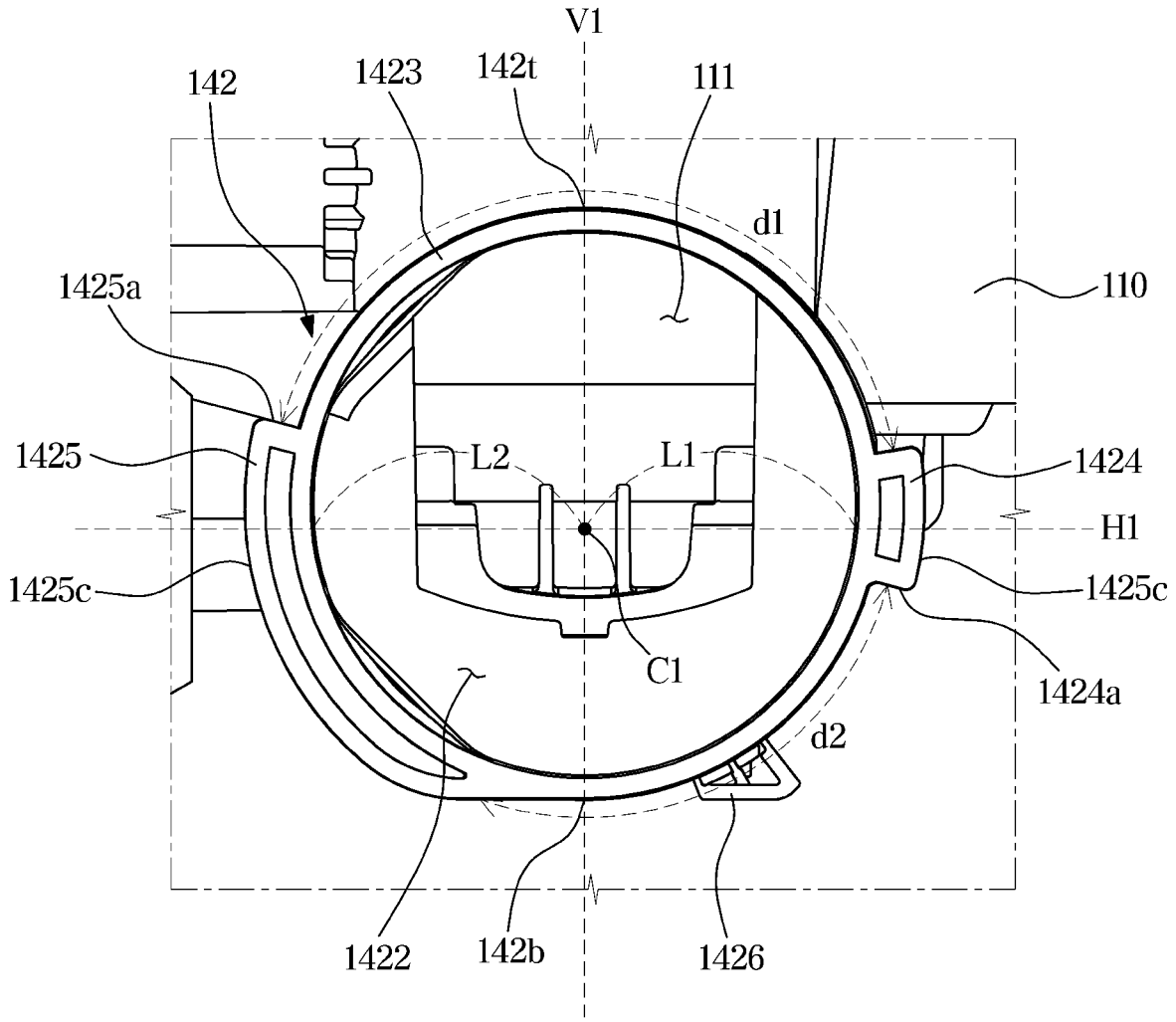
FIG. 9 shows the sump housing shown in FIG. 8, in an A direction.

FIG. 8 is a perspective view of a sump housing of a dishwasher according to an embodiment of the disclosure. FIG. 9 shows the sump housing shown in FIG. 8, in an A direction.

Referring to FIGS. 8 and 9, for example, the drain port 142 may be provided as a component of the sump housing 100. The drain port 142 may be formed in the first sump body 110 of the sump housing 100, although not limited thereto. However, the drain port 142 may be provided as an independent component separated from the sump housing 100.

The drain port 142 may communicate with the tub 12. For example, the drain port 142 may communicate with the water storage chamber 111. For example, the drain port 142 may communicate with a drain pipe connecting portion 143 to which a drain pipe 22 is detachably coupled.

While a pump operation is performed in a state in which the drain pump 600 is coupled to the drain port 142, water and foreign materials remaining in the water storage chamber 111 may enter the drain pipe connecting portion 143 by passing through the drain port 142. The water and foreign materials entered the drain pipe connecting portion 143 may be discharged to outside of the dishwasher 1*a* through the drain pipe 22.

The drain port 142 may be positioned at a lower location than the water storage chamber 111. Accordingly, the water and foreign materials remaining in the water storage chamber 111 may smoothly enter the drain port 142 positioned at the lower location than the water storage chamber 111. That is, a drain operation of the dishwasher 1*a* may be smoothly performed.

The drain port 142 may include a port body 1421. The port body 1421 may form an outer appearance of the drain port 142. For example, the port body 1421 may be substantially in a shape of a hollow cylinder, although not limited thereto. However, the port body 1421 may include various shapes as long as the port body 1421 communicates with the water storage chamber 111.

Water pumped by the drain pump 600 may flow to the port body 1421. Foreign materials (for example, food waste, etc.) pumped by the drain pump 600 may flow to the port body 1421.

A body space 1422 may be formed inside the port body 1421. Water and foreign materials may flow along the body space 1422. The body space 1422 may communicate with the water storage chamber 111. Water and foreign materials of the water storage chamber 111 may pass through the body space 1422 and then flow to the drain pipe connecting portion 143.

For example, in the drain port 142 seen in the A direction denoted in FIG. 8 (that is, referring to FIG. 9), a line passing a center C1 of the drain port 142 in the horizontal direction may be defined as a first horizontal line H1. For example, in the drain port 142 seen in the A direction denoted in FIG. 8 (that is, referring to FIG. 9), a line passing an uppermost portion 142*t* of the drain port 142, the center C1 of the drain port 142, and a lowermost portion 142*b* of the drain port 142 in a vertical direction may be defined as a first vertical line V1.

The drain port 142 may include port coupling portions 1424 and 1425 to which the drain pump 600 is coupled. The drain pump 600 may be coupled to the port coupling portions 1424 and 1425 and fixed to the sump housing 100. For example, the port coupling portions 1424 and 1425 may be formed at an edge 1423 of the port body 1421. For example, the port coupling portions 1424 and 1425 may be formed at an open end portion of the port body 1421. For example, the port coupling portions 1424 and 1425 may be formed as protrusions. The port coupling portions 1424 and 1425 may also be referred to as coupling protrusions 1424 and 1425.

For example, the port coupling portions 1424 and 1425 may include a first port coupling portion 1424 and a second port coupling portion 1425.

The first port coupling portion 1424 may be formed at a side of the edge 1423 of the port body 1421. The first port coupling portion 1424 may protrude in a radial direction from an outer surface of the port body 1421. The first port coupling portion 1424 may extend along the edge 1423 of the port body 1421. The first port coupling portion 1424 may extend along an edge of an outer circumferential surface of the port body 1421. The first port coupling portion 1424 may be formed along the edge of the outer circumferential surface of the port body 1421. The first port coupling portion 1424 may be formed in a circumferential direction from the outer circumferential surface of the port body 1421. The first port coupling portion 1424 may be referred to as a first coupling protrusion 1424.

The second port coupling portion 1425 may be formed at another side of the edge 1423 of the port body 1421. The second port coupling portion 1425 may protrude in the radial direction from the outer surface of the port body 1421. The second port coupling portion 1425 may extend along the edge 1423 of the port body 1421. The second port coupling portion 1425 may extend along the edge of the outer circumferential surface of the port body 1421. The second port coupling portion 1425 may be formed along the edge of the outer circumferential surface of the port body 1421. The second port coupling portion 1425 may extend in the circumferential direction from the outer circumferential surface of the port body 1421. The second port coupling portion 1424 may be referred to as a second coupling protrusion 1425.

For example, referring to FIG. 9, the first port coupling portion 1424 may be opposite to the second port coupling portion 1425 with respect to the first vertical line V1. A distance L1 from the center C1 of the drain port 142 to the first port coupling portion 1424 on the first horizontal line H1 may be substantially equal to a distance L2 from the center C1 of the drain port 142 to the second port coupling portion 1425 on the first horizontal line H1.

For example, the second port coupling portion 1425 may be longer than the first port coupling portion 1424. The second port coupling portion 1425 may extend with a longer length than the first port coupling portion 1424 along the edge 1423 of the outer circumferential surface of the drain port 142. The second port coupling portion 1425 may be longer than the first port coupling portion 1424 in the circumferential direction. The second port coupling portion 1425 may extend from a higher location than the first horizontal line H1 to a location being adjacent to the lowermost portion 142*b* of the drain port 142. Accordingly, a distance d1 between an upper end portion 1425*a* of the first port coupling portion 1424 and an upper end portion of the second port coupling portion 1425 in the circumferential direction may be longer than a distance d2 between a lower end portion 1424*a* of the first port coupling portion 1424 and a lower end portion of the second port coupling portion 1425 in the circumferential direction. The upper end portion of the first port coupling portion 1424 may be an end portion that is distant from the second port coupling portion 1425. The lower end portion 1424*a* of the first port coupling portion 1424 may be an end portion that is close to the second port coupling portion 1425. The upper end portion 1425*a* of the second port coupling portion 1425 may be an end portion that is distant from the first port coupling portion 1424. The lower end portion of the second port coupling portion 1425 may be an end portion that is close to the first port coupling portion 1424. However, the disclosure is not limited to the above-described example. Shapes and locations of the first and second port coupling portions 1424 and 1425 are not limited as long as the second port coupling portion 1425 is longer than the first port coupling portion 1424.

Because the second port coupling portion 1425 is longer than the first port coupling portion 1424, the drain pump 600 may be coupled to the drain port 142 at a correct assembling location. For example, in a case in which the drain pump 600 turned reversely is inserted into the drain port 142, an interfering rib 613 (will be described below) of the drain pump 600 may interfere with the second port coupling portion 1425 having a relatively long length. Accordingly, the drain pump 600 turned reversely may have difficulties in being fixed to the drain port 142. That is, assembling the drain pump 600 turned reversely with the drain port 142 may be limited.

The drain port 142 may include a locking portion 1426. The locking portion 1426 may be formed at a lower portion of the port body 1421. The locking portion 1426 may be positioned below the first horizontal line H1. The locking portion 1426 may protrude downward from the port body 1421. A hooking protrusion 614 (will be described below) of the drain pump 600 may be caught by the locking portion 1426.

Figure 10:
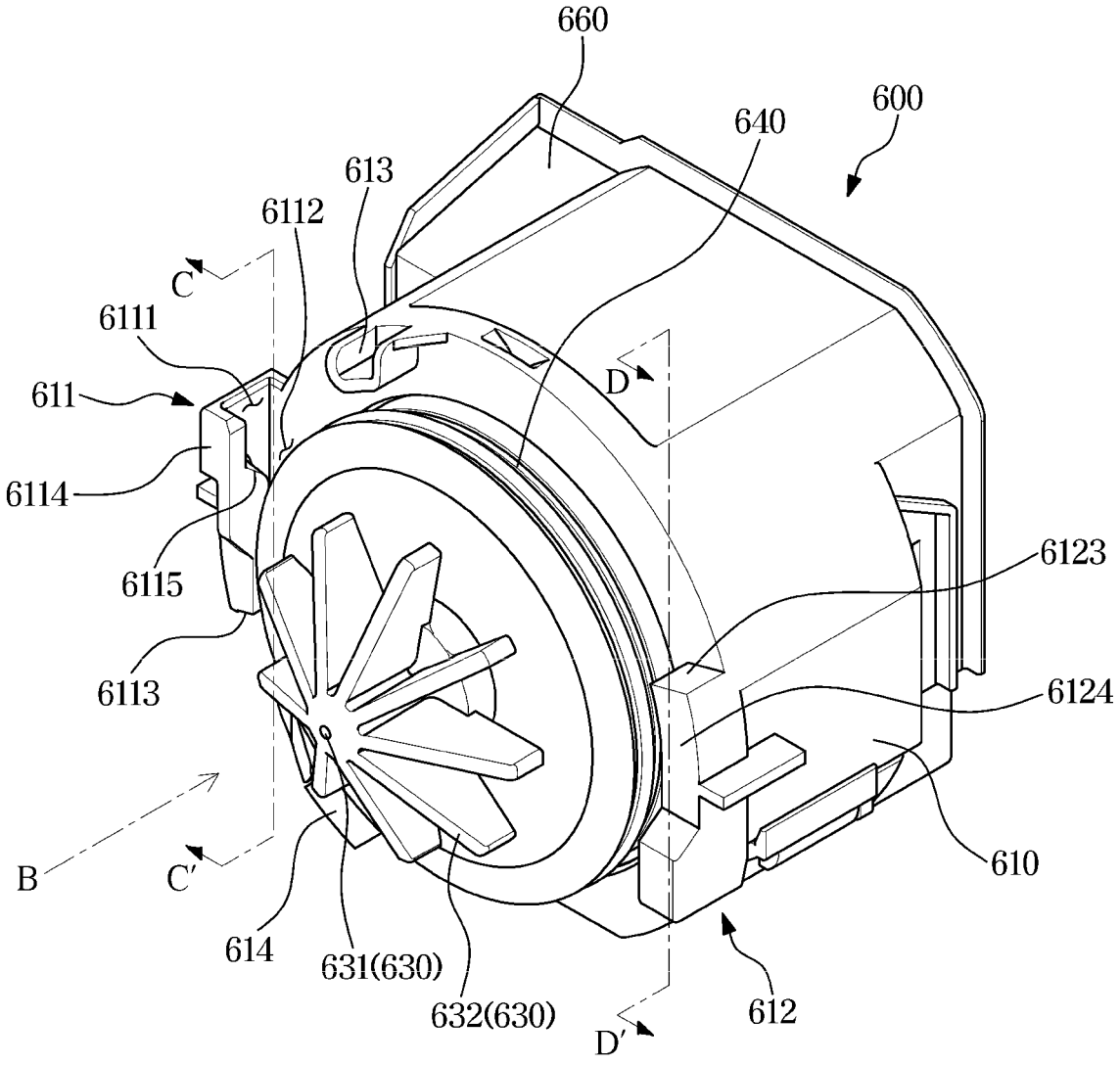
FIG. 10 is a perspective view of a drain pump according to an embodiment of the disclosure.
Figure 11:
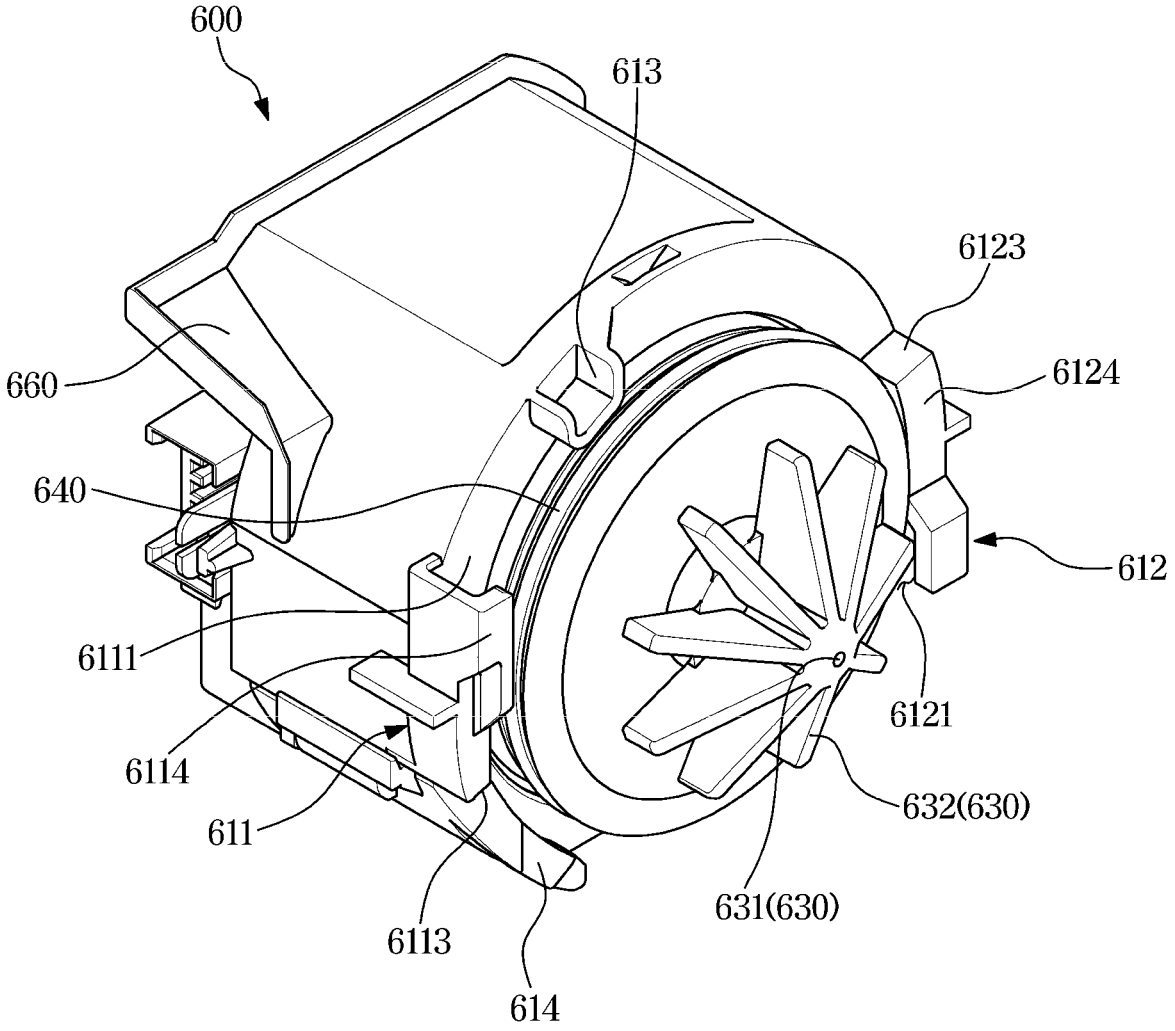
FIG. 11 is a perspective view showing the drain pump shown in FIG. 10, in another direction according to an embodiment of the disclosure.
Figure 12:
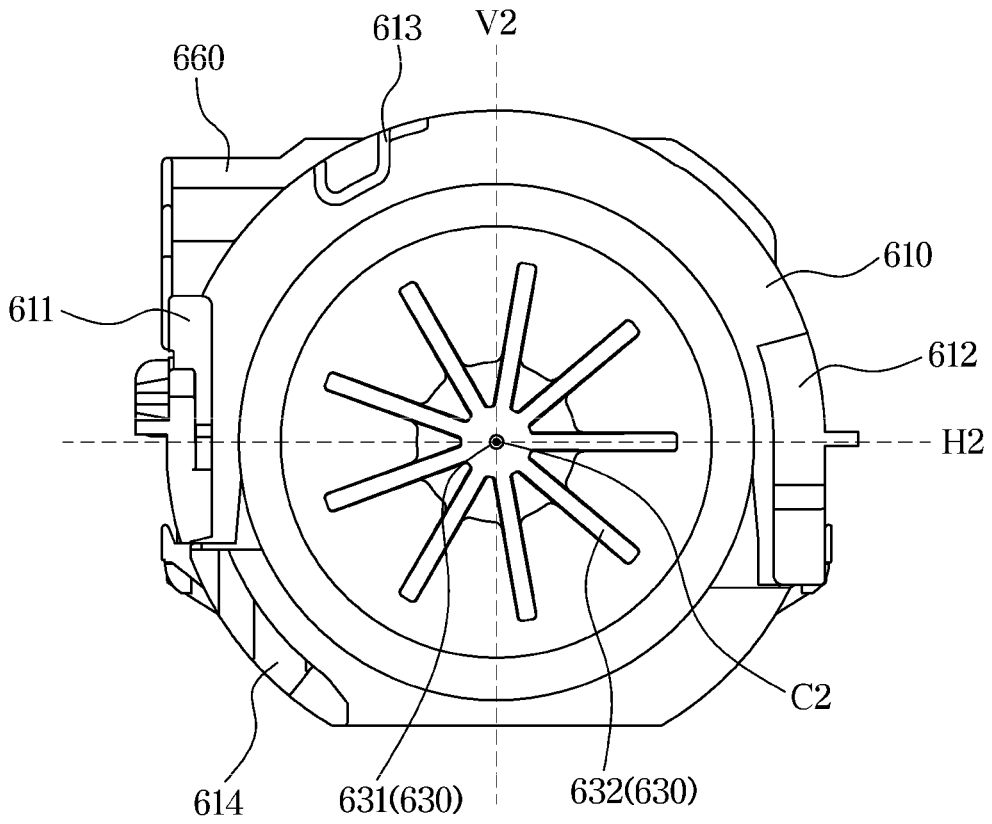
FIG. 12 shows the drain pump shown in FIG. 10, in a B direction according to an embodiment of the disclosure.
Figure 13:
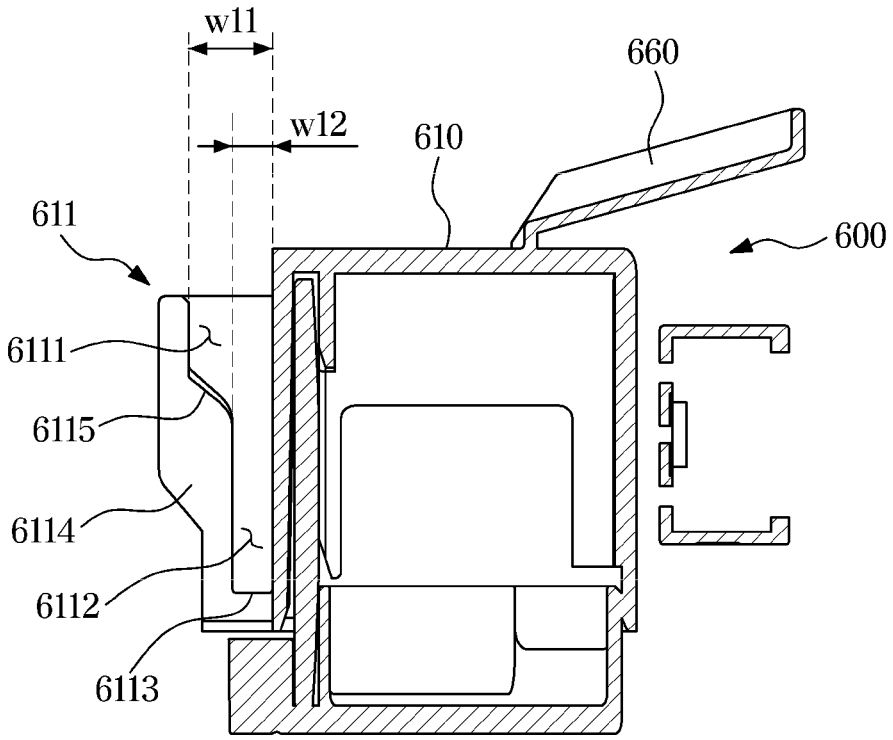
FIG. 13 is a cross-sectional view taken along line C-C' denoted in FIG. 10 according to an embodiment of the disclosure.
Figure 14:
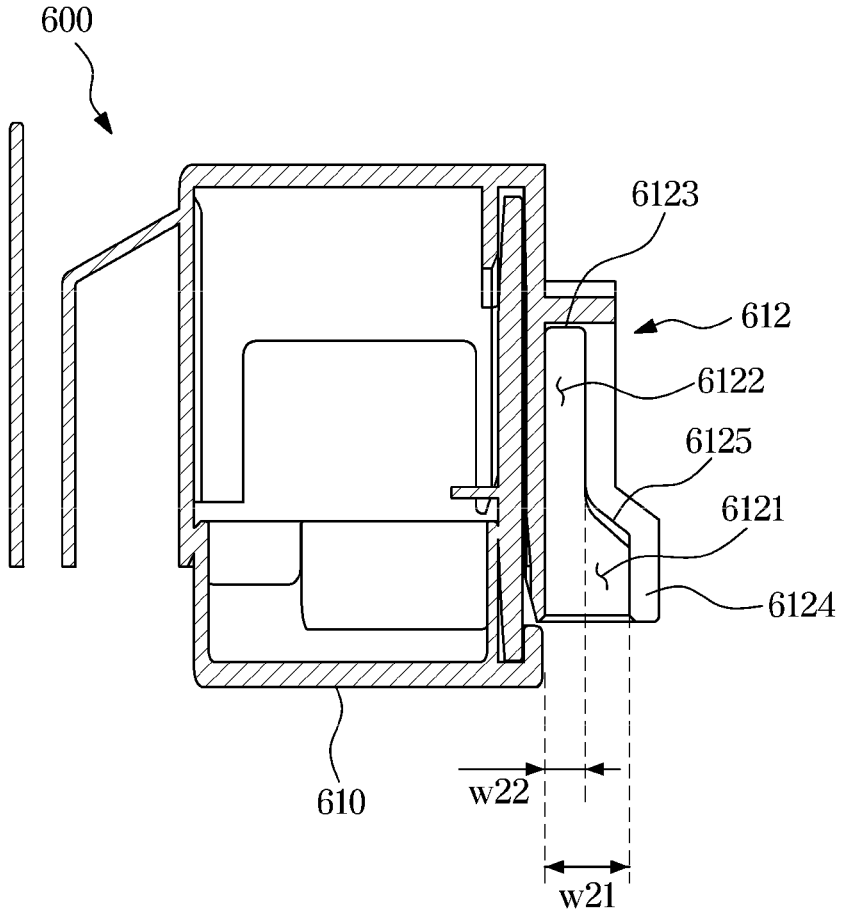
FIG. 14 is a cross-sectional view taken along line D-D' denoted in FIG. 10 according to an embodiment of the disclosure.

FIG. 10 is a perspective view of a drain pump according to an embodiment of the disclosure. FIG. 11 is a perspective view showing the drain pump shown in FIG. 10, in another direction. FIG. 12 shows the drain pump shown in FIG. 10, in a B direction. FIG. 13 is a cross-sectional view taken along line C-C' denoted in FIG. 10. FIG. 14 is a cross-sectional view taken along line D-D' denoted in FIG. 10.

Referring to FIGS. 10 to 14, the drain pump 600 may include a pump case 610 forming an outer appearance of the drain pump 600, a drain motor 620 (see FIG. 19) accommodated inside the pump case 610, and an impeller 630 connected to the drain motor 620 to rotate.

For example, in the drain pump 600 seen in the B direction denoted in FIG. 10 (that is, referring to FIG. 12), a line passing a rotation center C2 of the drain pump 600 in the horizontal direction may be defined as a second horizontal line H2. In the drain pump 600 seen in the B direction denoted in FIG. 10 (that is, referring to FIG. 12), a line passing the rotation center C2 of the drain pump 600 in the vertical direction may be defined as a second vertical line V2.

The drain pump 600 may include the pump case 610. The pump case 610 may accommodate the drain motor 620.

The drain pump 600 may include pump coupling portions 611 and 612. The pump coupling portions 611 and 612 of the drain pump 600 may be coupled to the port coupling portions 1424 and 1425 of the drain port 142. The pump coupling portions 611 and 612 may be detachably coupled to the port coupling portions 1424 and 1425. The pump coupling portions 611 and 612 may be rotatably coupled to the port coupling portions 1424 and 1425. According to a rotation of the drain pump 600 in a direction R (see FIG. 16) with respect to the drain port 142 in a state of being inserted in the drain port 142, the pump coupling portion 611 and 612 may be coupled to the port coupling portions 1424 and 1425. As a result of the coupling of the pump coupling portions 611 and 612 to the port coupling portions 1424 and 1425, the drain pump 600 may be installed in the sump housing 100.

The pump coupling portions 611 and 612 may be formed in the pump case 610. For example, the pump coupling portions 611 and 612 may be formed in a side of the pump case 610 toward the drain port 142. For example, the pump coupling portions 611 and 612 may be formed as hooks. The pump coupling portions 611 and 612 may also be referred to as coupling hooks 611 and 612.

For example, the pump coupling portions 611 and 612 may include a first pump coupling portion 611 and a second pump coupling portion 612.

The first pump coupling portion 611 may be formed in a side of the pump case 610. The first pump coupling portion 611 may be formed to correspond to the first port coupling portion 1424 of the drain port 142. The first pump coupling portion 611 may be coupled to the first port coupling portion 1424. The first pump coupling portion 611 may have difficulties in being coupled to the second port coupling portion 1425. Details about this will be described below.

The second pump coupling portion 612 may be formed in another side of the pump case 610. The other side of the pump case 610 may correspond to another area that is different from the side of the pump case 610 in which the first pump coupling portion 611 is formed. The second pump coupling portion 612 may be formed to correspond to the second port coupling portion 1425 of the drain port 142. The second pump coupling portion 612 may be coupled to the second port coupling portion 1425. The second pump coupling portion 612 may have difficulties in being coupled to the first port coupling portion 1424. Details about this will be described below.

For example, the first pump coupling portion 611 may be opposite to the second pump coupling portion 612 with respect to the second vertical line V2.

For example, the first pump coupling portion 611 and the second pump coupling portion 612 may be in a shape of point symmetry with respect to the rotation center C2 of the drain pump 600. For example, the first pump coupling portion 611 and the second pump coupling portion 612 may be in a shape of point symmetry with respect to the rotation axis 600*a* of the drain pump 600. By the shape, the drain pump 600 may be rotatably coupled to the drain port 142. For example, by a rotation of the drain pump 600, an upper end portion of the first pump coupling portion 611 may start to be coupled to the lower end portion 1424*a* of the first port coupling portion 1424, and a lower end portion of the second pump coupling portion 612 may start to be coupled to the upper end portion 1425*a* of the second port coupling portion 1425. That is, according to a rotation of the drain pump 600, the first pump coupling portion 611 may be coupled to the first port coupling portion 1424, and the second pump coupling portion 612 may be coupled to the second port coupling portion 1425. However, the disclosure is not limited to the above-described example, and there may be various coupling methods according to shapes of the drain pump 600 and the pump case 610. By a rotation of the drain pump 600, the lower end portion of the first pump coupling portion 611 may start to be coupled to the upper end portion of the first port coupling portion 1424, and the upper end portion of the second pump coupling portion 612 may start to be coupled to the lower end portion of the second port coupling portion 1425.

In summary, the drain pump 600 may be rotatably coupled to the drain port 142. For example, the first pump coupling portion 611 may be rotatably coupled to the first port coupling portion 1424. For example, the second pump coupling portion 612 may be rotatably coupled to the second port coupling portion 1425. For example, while the first pump coupling portion 611 rotates in the direction R along the edge of the first port coupling portion 1424, and the second pump coupling portion 612 rotates in the direction R along the edge of the second port coupling portion 1425, the drain pump 600 may be coupled to the drain port 142.

For example, the first pump coupling portion 611 may rotate while climbing over an edge surface 1424*c* of the first port coupling portion 1424. For example, the first pump coupling portion 611 may rotate in the circumferential direction while climbing over the edge surface 1424*c* of the first port coupling portion 1424. For example, the first pump coupling portion 611 may be coupled to the first port coupling portion 1424 by rotating while climbing over the edge surface 1424*c* of the first port coupling portion 1424. Thereby, the first pump coupling portion 611 may be coupled to the first port coupling portion 1424 while guiding the first port coupling portion 1424.

For example, the second pump coupling portion 612 may rotate while climbing over an edge surface 1425*c* of the second port coupling portion 1425. For example, the second pump coupling portion 612 may rotate in the circumferential direction while climbing over the edge surface 1425*c* of the second port coupling portion 1425. For example, the second pump coupling portion 612 may be coupled to the second port coupling portion 1425 by rotating while climbing over the edge surface 1425*c* of the second port coupling portion 1425. The second pump coupling portion 612 may be coupled to the second port coupling portion 1425 while guiding the second port coupling portion 1425.

For example, referring to FIG. 13, the drain pump 600 may include a first groove 6111. The drain pump 600 may include a second groove 6112. The drain pump 600 may include a stopper 6113.

For example, the first pump coupling portion 611 may include the first groove 6111. The first pump coupling portion 611 may include the second groove 6112. The first pump coupling portion 611 may include the stopper 6113. Hereinafter, an example in which the first pump coupling portion 611 includes the first groove 6111, the second groove 6112, and the stopper 6113 will be described.

While the drain pump 600 is inserted in the drain port 142 and starts to rotate with respect to the drain port 142 (that is, a case in which the drain pump 600 is located at a first position P1 which will be described below), the first groove 6111 of the first pump coupling portion 611 may open toward the first port coupling portion 1424. At this time, for example, the first groove 6111 of the first pump coupling portion 611 may open upward to correspond to the lower end portion 1424*a* of the first port coupling portion 1424, although not limited thereto. The first groove 6111 of the first pump coupling portion 611 may open downward to correspond to the upper end portion of the first port coupling portion 1424.

The second groove 6112 of the first pump coupling portion 611 may extend from the first groove 6111. For example, the second groove 6112 may be positioned between the first groove 6111 and the stopper 6113. While the drain pump 600 is inserted in the drain port 142 and rotates in the direction R with respect to the drain port 142 to be fixed to the drain port 142 (that is, a case in which the drain pump 600 is located at a second position P2 which will be described below), the second groove 6112 may accommodate the first port coupling portion 1424.

The stopper 6113 of the first pump coupling portion 611 may limit a rotation in direction R of the first pump coupling portion 611. The stopper 6113 of the first pump coupling portion 611 may be in contact with the first port coupling portion 1424.

For example, the stopper 6113 of the first pump coupling portion 611 may be provided in a side of the second groove 6112, which is distant from the first groove 6111. While the drain pump 600 is inserted in the drain port 142 and rotates in the direction R with respect to the drain port 142 to be fixed to the drain port 142 (that is, a case in which the drain pump 600 is located at the second position P2 which will be described below), the stopper 6113 may prevent the drain pump 600 from rotating in the direction R. The stopper 6113 may limit the drain pump 600 from rotating in the direction R in a state of being fixed to the drain port 142. For example, while the drain pump 600 is inserted in the drain port 142 and rotates with respect to the drain port 142 to be fixed to the drain port 142 (that is, a case in which the drain pump 600 is located at the second position P2 which will be described below), the stopper 6113 may be in contact with the first port coupling portion 1424. Thereby, the drain pump 600 may be stably coupled to the drain port 142, and the drain pump 600 may rotate in the direction R to be prevented from departing from the second groove 6112.

The stopper 6113 may also be referred to as a first stopper 6113.

The first pump coupling portion 611 may include a guide wall 6114 for guiding the first port coupling portion 1424 upon a rotation of the drain pump 600. The guide wall 6114 may prevent the drain pump 600 from being separated from the drain port 142 in a direction of the rotation axis 600*a*, in a state in which the first pump coupling portion 611 is coupled to the first port coupling portion 1424. The guide wall 6114 may form at least one portion of the first groove 6111 or the second groove 6112. For example, the guide wall 6114 may be integrated into the stopper 6113.

The guide wall 6114 may include an inclined portion 6115. The inclined portion 6115 may smoothly guide the first port coupling portion 1424 that enters the second groove 6112 from the first groove 6111. By a rotation of the drain pump 600, the first port coupling portion 1424 may naturally move from the first groove 6111 to the second groove 6112 along the inclined portion 6115.

The first groove 6111 of the first pump coupling portion 611 may have a first width w11, and the second groove 6112 of the first pump coupling portion 611 may have a second width w12. The first width w11 of the first groove 6111 may be greater than the second width w12 of the second groove 6112. For example, the first width w11 may be greater than a thickness t1 (see FIG. 7) of the first port coupling portion 1424. For example, the second width w12 may be substantially equal to or greater than the thickness t1 of the first port coupling portion 1424. According to a rotation of the drain pump 600, the first port coupling portion 1424 may be guided into the first groove 6111 and coupled to the second groove 6112. For example, the second width w12 may be substantially equal to or smaller than the thickness t1 of the first port coupling portion 1424. The first port coupling portion 1424 may be closely fitted to the second groove 6112.

For example, referring to FIG. 14, the drain pump 600 may include a first groove 6121. The drain pump 600 may include a second groove 6122. The drain pump 600 may include a stopper 6123.

For example, the second pump coupling portion 612 may include the first groove 6121. The second pump coupling portion 612 may include the second groove 6122. The second pump coupling portion 612 may include the stopper 6123. Hereinafter, an example in which the second pump coupling portion 612 includes the first groove 6121, the second groove 6122, and the stopper 6123 will be described.

While the drain pump 600 is inserted in the drain port 142 and starts to rotate with respect to the drain port 142 (that is, a case in which the drain pump 600 is located at the first position P1 which will be described below), the first groove 6121 of the second pump coupling portion 612 may open toward the second port coupling portion 1425. At this time, for example, the first groove 6121 of the second pump coupling portion 612 may open downward to correspond to the upper end portion 1425*a* of the second port coupling portion 1425, although not limited thereto. However, the first groove 6121 of the second pump coupling portion 612 may open upward to correspond to the lower end portion of the second port coupling portion 1425.

The second groove 6122 of the second pump coupling portion 612 may extend from the first groove 6121. For example, the second groove 6122 may be positioned between the first groove 6121 and the stopper 6123. While the drain pump 600 is inserted in the drain port 142 and rotates in the direction R with respect to the drain port 142 to be fixed to the drain port 142 (that is, a case in which the drain pump 600 is located at the second position P2 which will be described below), the second groove 6122 may accommodate the second port coupling portion 1425.

The stopper 6123 of the second pump coupling portion 612 may limit a rotation in direction R of the second pump coupling portion 612. The stopper 6123 of the second pump coupling portion 612 may be in contact with the second port coupling portion 1425.

For example, the stopper 6123 of the second pump coupling portion 612 may be provided in a side of the second groove 6122, which is distant from the first groove 6121. While the drain pump 600 is inserted in the drain port 142 and rotates in the direction R with respect to the drain port 142 to be fixed to the drain port 142 (that is, a case in which the drain pump 600 is located at the second position P2 which will be described below), the stopper 6123 may prevent the drain pump 600 from rotating in the direction R. The stopper 6123 may limit the drain pump 600 fixed to the drain port 142 from rotating in the direction R. For example, while the drain pump 600 is inserted in the drain port 142 and rotates with respect to the drain port 142 to be fixed to the drain port 142 (that is, a case in which the drain pump 600 is located at the second position P2 which will be described below), the stopper 6123 may be in contact with the second port coupling portion 1425. Thereby, the drain pump 600 may be stably coupled to the drain port 142, and the drain pump 600 may rotate in the direction R to be prevented from departing from the second groove 6122.

The stopper 6123 may also be referred to as a second stopper 6123.

The second pump coupling portion 612 may include a guide wall 6124 for guiding the second port coupling portion 1425 according to a rotation of the drain pump 600. The guide wall 6124 may prevent the drain pump 600 from being separated from the drain port 142 in the direction of the rotation axis 600*a*, in a state in which the second pump coupling portion 612 is coupled to the second port coupling portion 1425. The guide wall 6124 may form at least one portion of the first groove 6121 or the second groove 6122. For example, the guide wall 6124 may be integrated into the stopper 6123.

The guide wall 6124 may include an inclined portion 6125. The inclined portion 6125 may smoothly guide the second port coupling portion 1425 that enters the second groove 6122 from the first groove 6121. By a rotation of the drain pump 600, the second port coupling portion 1425 may naturally move from the first groove 6121 to the second groove 6122 along the inclined portion 6115.

The first groove 6121 of the second pump coupling portion 611 may have a first width w21, and the second groove 6122 of the second pump coupling portion 612 may have a second width w22. The first width w21 of the first groove 6121 may be greater than the second width w22 of the second groove 6122. For example, the first width w21 may be greater than a thickness t2 (see FIG. 6) of the second port coupling portion 1425. For example, the second width w22 may be substantially equal to or greater than the thickness t2 of the second port coupling portion 1425. According to a rotation of the drain pump 600, the second port coupling portion 1425 may be guided into the first groove 6121 and coupled to the second groove 6122. For example, the second width w22 may be substantially equal to or smaller than the thickness t2 of the second port coupling portion 1425. The second port coupling portion 1425 may be closely fitted to the second groove 6122.

The drain pump 600 may include the interfering rib 613. The interfering rib 613 may prevent the drain pump 600 from being mis-assembled with the drain port 142. The interfering rib 613 may prevent the drain pump 600 from being reversely assembled with the drain port 142. For example, the interfering rib 613 may prevent the first pump coupling portion 611 from being coupled to the second port coupling portion 1425 or the second pump coupling portion 612 from being coupled to the first port coupling portion 1424. For example, in a state in which the first pump coupling portion 611 corresponds to the second port coupling portion 1425 and the second pump coupling portion 612 corresponds to the first port coupling portion 1424, the interfering rib 613 may interfere with the drain port 142. According to the interference of the interfering rib 613 with the drain port 142, the drain pump 600 may have difficulties in being coupled to the drain port 142. However, in a state in which the drain pump 600 is correctly assembled with the drain port 142, the interfering rib 613 may not interfere with the drain port 142. Details about this will be described below.

The interfering rib 613 may be formed in the pump case 610. The interfering rib 613 may be formed in a side of the pump case 610, which is toward the drain port 142. The interfering rib 613 may protrude toward the drain port 142. The interfering rib 613 may be positioned between the first pump coupling portion 611 and the second pump coupling portion 612. The interfering rib 613 may be positioned above the second horizontal line H2. In a state in which the drain pump 600 is correctly assembled with the drain port 142 (that is, the state in which the drain pump 600 is located at the second position P2 which will be described below), the interfering rib 613 may be positioned above the first pump coupling portion 611 and the second pump coupling portion 612.

The drain pump 600 may include the hooking protrusion 614. The hooking protrusion 614 of the drain pump 600 may be coupled to the locking portion 1426 of the drain port 142. For example, while the drain pump 600 is inserted in the drain port 142 and rotates in the direction R with respect to the drain port 142 to be fixed to the drain port 142 (that is, a case in which the drain pump 600 is located at the second position P2 which will be described below), the hooking protrusion 614 may be caught by the locking portion 1426. Accordingly, by additional coupling between the hooking protrusion 614 and the locking portion 1426, in addition of coupling between the pump coupling portions 611 and 612 and the port coupling portions 1424 and 1425, the drain pump 600 may be stably fixed to the drain port 142. Because the hooking protrusion 614 is firmly fixed to the locking portion 1426, the drain pump 600 may be prevented from being easily separated from the sump housing 100 by an external impact.

For example, because the hooking protrusion 614 is fixed to the locking portion 1426 formed in a lower portion of the drain port 142, the hooking protrusion 614 fixed to the locking portion 1426 may also be positioned in the lower portion of the drain port 600. That is, in a state in which the hooking protrusion 614 is caught by the locking portion 1426, the hooking protrusion 614 and the locking portion 1426 may be positioned toward a down direction of the sump assembly 70. Accordingly, a worker, a user, etc. may easily access the hooking protrusion 614 and the locking portion 1426. Details about this will be described below.

The hooking protrusion 614 may be formed in the pump case 610. That is, the hooking protrusion 614 may be formed in a side of the pump case 610, which is toward the drain port 142. The hooking protrusion 614 may be located below the second horizontal line H2. In a state in which the drain pump 600 is correctly assembled with the drain port 142 (that is, a state in which the drain pump 600 is located at the second position P2 which will be described below), the hooking protrusion 614 may be positioned below the first pump coupling portion 611 and the second pump coupling portion 612.

Figure 19:
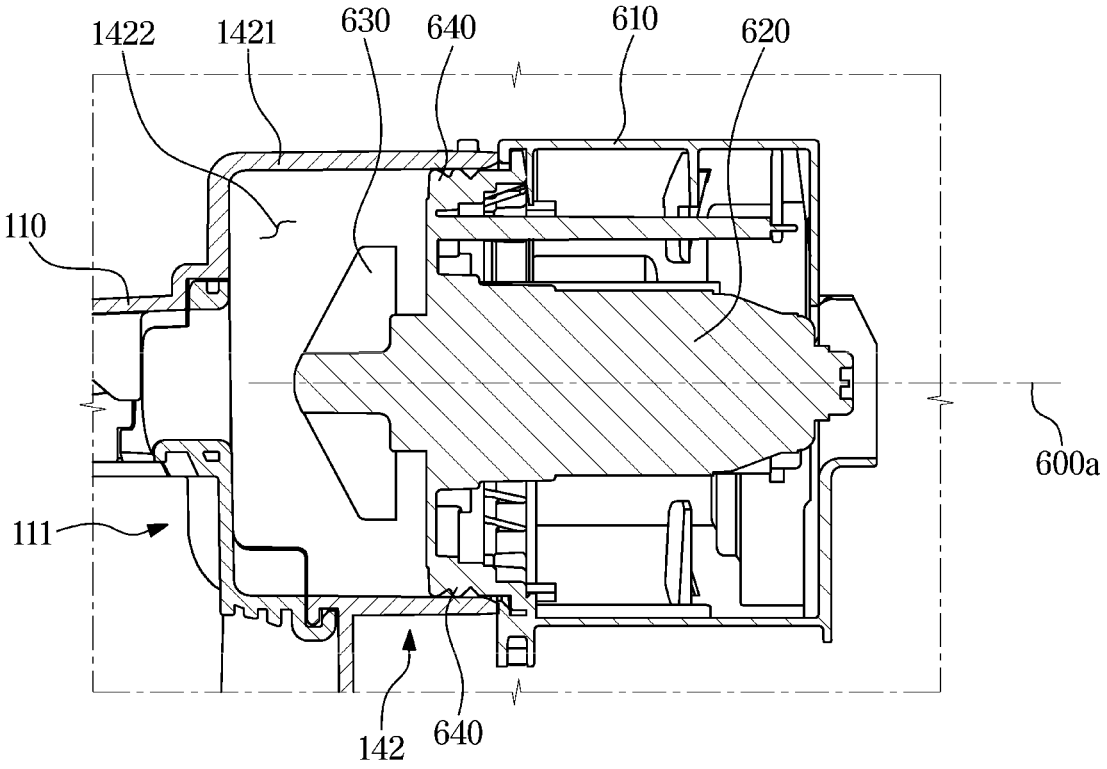
FIG. 19 is a cross-sectional view taken along line F-F' denoted in FIG. 17 according to an embodiment of the disclosure.

The drain pump 600 may include the drain motor 620 (see FIG. 19). The drain motor 620 may generate a rotation force to pump water and foreign materials accommodated in the water storage chamber 111. The drain motor 620 may include a stator (not shown) and a rotor (not shown). The drain motor 620 may be accommodated inside the pump case 610. For example, the drain motor 620 may be a brushless direct current (BLDC) motor.

The drain pump 600 may include the impeller 630. The impeller 630 may be connected to the drain motor 620. The impeller 630 may rotate by being connected to a motor shaft of the drain motor 620. By a rotation of the impeller 630, water and foreign materials in the water storage chamber 111 may flow to the drain pump 600 and the drain pipe connecting portion 143.

For example, the impeller 630 may include a hub 631 positioned at a center and a blade 632 extending outward in a radial direction from the hub 631. A plurality of blades 632 may be provided. In the drawings, 9 blades 632 are shown. However, the number of the blades 632 is not limited to 9, and 8 or less blades 632 or 10 or more blades 632 may be provided.

The drain pump 600 may include a sealing protrusion 640. The sealing protrusion 640 may seal between the drain port 142 and the drain pump 600. The sealing protrusion 640 may prevent water from leaking between the drain port 142 and the drain pump 600. In a state in which the drain pump 600 is coupled to the drain port 142, the sealing protrusion 640 may be positioned inside the drain port 142. For example, the sealing protrusion 640 may include a ring shape, although not limited thereto. However, the sealing protrusion 640 may include various shapes.

The drain pump 600 may include a pump connector 650. The pump connector 650 may transmit and receive an electrical signal. For example, the pump connector 650 may be electrically connected to a controller (not shown).

The drain pump 600 may include a connector cover 660. The connector cover 660 may cover the pump connector 650 to prevent water from entering the pump connector 650. In a state in which the drain pump 600 is correctly assembled with the drain port 142, the connector cover 600 may be positioned above the connector terminal 650. The connector cover 600 may be positioned above the second horizontal line H2. That is, the drain pump 600 may cover an upper portion of the pump connector 650. For example, the connector cover 660 may include a downwardly inclined shape such that water smoothly falls down without entering the pump connector 650.

Figure 15:
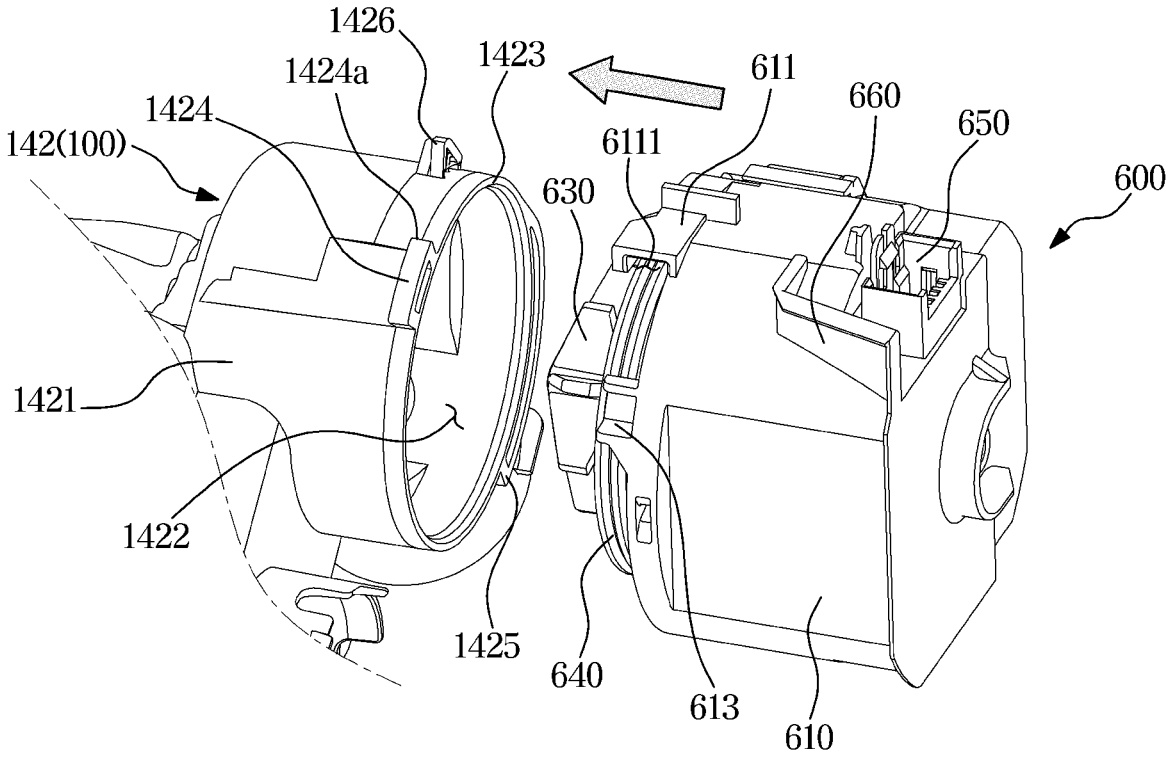
FIG. 15 shows an example of a state in which a drain pump according to an embodiment of the disclosure is arranged to be correctly assembled with the drain port.
Figure 16:
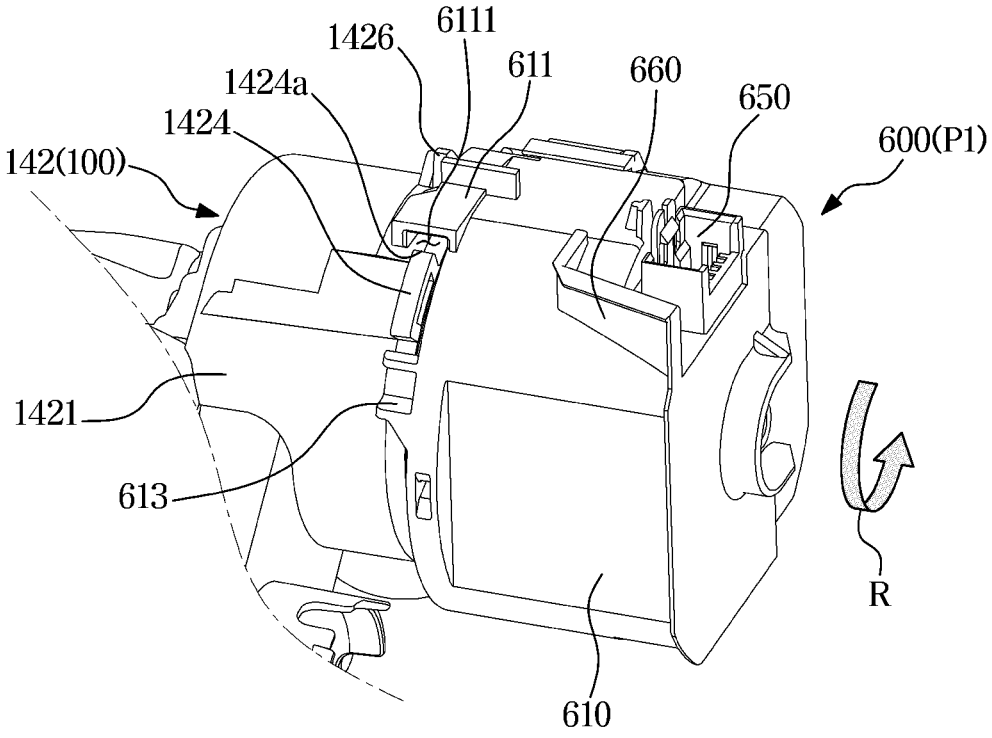
FIG. 16 shows a state (a state in which the drain pump is located at a first position) in which the drain pump shown in FIG. 15 is detachably inserted in the drain port according to an embodiment of the disclosure.
Figure 17:
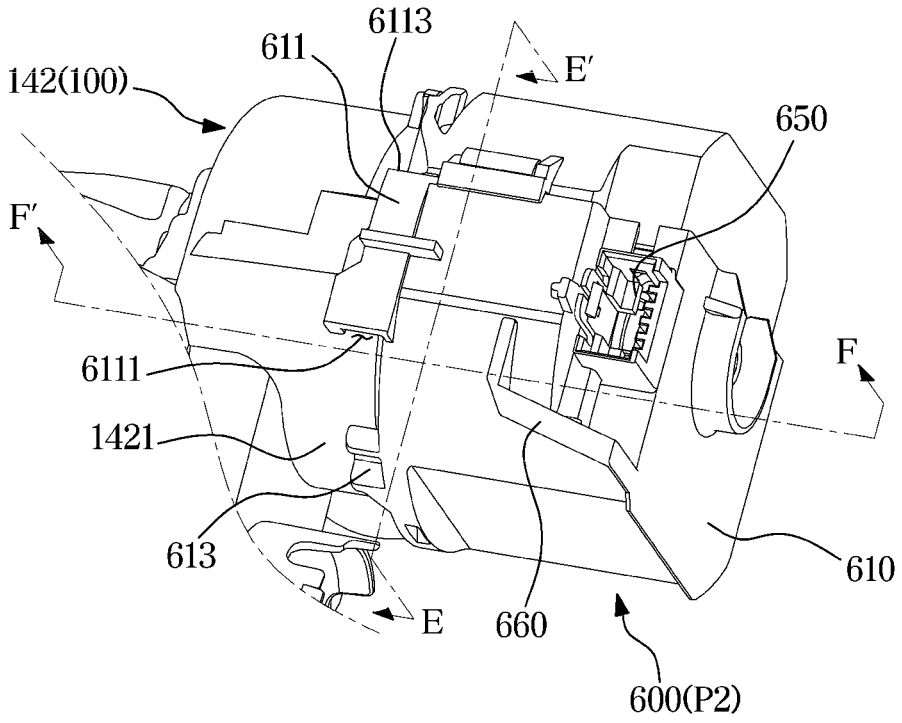
FIG. 17 shows a state (a state in which the drain pump is located at a second position) in which the drain pump shown in FIG. 16 is fixed to the drain port by rotating according to an embodiment of the disclosure.
Figure 18:
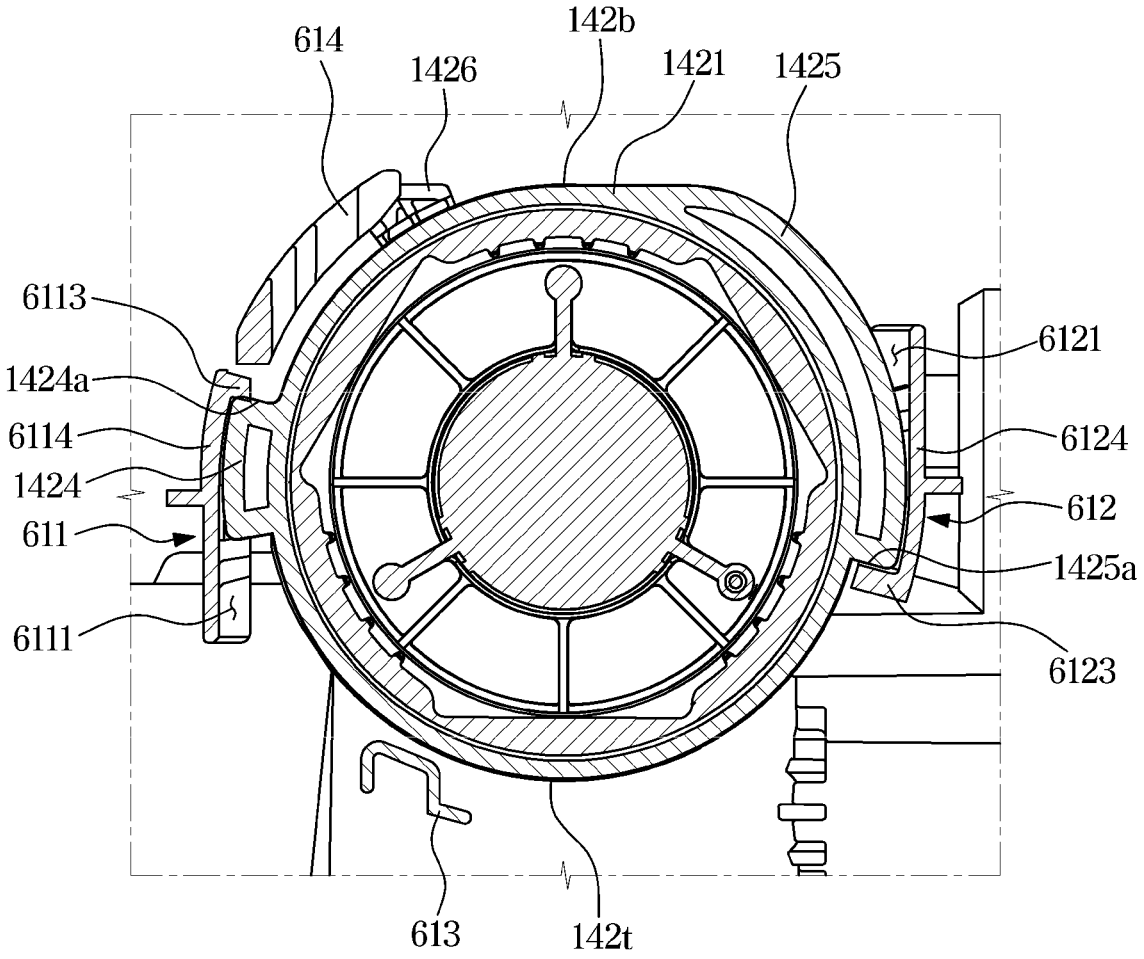
FIG. 18 is a cross-sectional view taken along line E-E' denoted in FIG. 17 according to an embodiment of the disclosure.

FIG. 15 shows an example of a state in which a drain pump according to an embodiment of the disclosure is arranged to be correctly assembled with the drain port. FIG. 16 shows a state (a state in which the drain pump is located at the first position) in which the drain pump shown in FIG. 15 is detachably inserted in the drain port. FIG. 17 shows a state (a state in which the drain pump is located at the second position) in which the drain pump shown in FIG. 16 is fixed to the drain port by rotating. FIG. 18 is a cross-sectional view taken along line E-E' denoted in FIG. 17. FIG. 19 is a cross-sectional view taken along line F-F' denoted in FIG. 17.

Meanwhile, a worker, etc. may provide a service in a state in which the dishwasher 1*a* is reversely placed. For example, a worker, etc. may install the drain pump 600 in the drain port 142 or disassemble the drain pump 600 from the drain port 142 after he/she places the dishwasher 1*a* such that the bottom 16*a* of the base frame 16 is upward (see FIGS. 24 to 27). FIGS. 15 to 19 may be views provided in view of a worker providing a service.

An example of a process for correctly assembling the drain pump 600 with the drain port 142 will be described with reference to FIGS. 15 to 19.

Referring to FIG. 15, the drain pump 600 may be arranged at a correct assembling position with respect to the drain port 142. That the drain pump 600 is "arranged at a correct assembling position" may be a state in which the drain pump 600 is arranged such that, while the drain pump 600 is inserted in the drain port 142 and rotates, the first pump coupling portion 611 is stably coupled to the first port coupling portion 1424 and the second pump coupling portion 612 is stably coupled to the second port coupling portion 1425. For example, the drain pump 600 located at the first position P1 (see FIG. 16) which will be described below may be in a state of being separated from the drain port 142 in the direction of the rotation axis 600*a*.

For example, the state in which the drain pump 600 is arranged at the correct assembling position may be a state in which the drain pump 600 has rotated to substantially 45 degrees in a clockwise direction, although not limited thereto. A rotation direction and rotation range of the drain pump 600 may depend on shapes and positions of the pump coupling portions 611 and 612 and the port coupling portions 1424 and 1425.

Referring to FIGS. 16 and 17, the drain pump 600 may be rotatable between the first position P1 and the second position P2.

For example, the drain pump 600 may be movable between the first position P1 at which the drain pump 600 is inserted in the drain port 142 and the second position P2 at which the drain pump 600 is installed in the drain port 142 by rotating in the direction R from the first position P1.

Referring to FIG. 16, the drain pump 600 shown in FIG. 15 may be inserted in the drain port 142 in the direction of the rotation axis 600*a*. That is, the drain pump 600 may be inserted in the drain port 142 in the direction of the rotation axis 600*a* in the state of being arranged at the correct assembling position. For example, the impeller 630 and the sealing protrusion 640 of the drain pump 600 may be positioned in the body space 1422 of the drain port 142.

The drain pump 600 may be located at the first position P1 at which the drain pump 600 is detachably inserted in the drain port 142. The drain pump 600 located at the first position P1 may be separated from the drain port 142 in the direction of the rotation axis 600*a* without any interference. That is, while the drain pump 600 is located at the first position P1, the pump coupling portions 611 and 612 of the drain pump 600 may be not yet coupled to the port coupling portions 1424 and 1425 of the drain port 142. In other words, the drain pump 600 may be not yet fixed to the sump housing 100. While the drain pump 600 is located at the first position P1, the drain pump 600 may be in a state of being inserted in the drain port 142 to be rotatable with respect to the drain port 142.

For example, while the drain pump 600 is located at the first position P1, the first pump coupling portion 611 may be positioned to open toward the first port coupling portion 1424 in consideration of the rotation direction R of the drain pump 600. For example, while the drain pump 600 is located at the first position P1, the first groove 6111 of the first pump coupling portion 611 may open toward the end portion 1424*a* of the first port coupling portion 1424. For example, while the drain pump 600 is located at the first position P1, the first groove 6111 of the first pump coupling portion 611 may be positioned to face the lower end portion 1424*a* of the first port coupling portion 1424.

For example, while the drain pump 600 is located at the first position P1, the second pump coupling portion 612 may be positioned to open toward the second port coupling portion 1425 in consideration of the rotation direction R of the drain pump 600. While the drain pump 600 is located at the first position P1, the first groove 6121 of the second pump coupling portion 612 may open toward an end portion 1425*a* of the second port coupling portion 1425. For example, while the drain pump 600 is located at the first position P1, the first groove 6121 of the second pump coupling portion 612 may be positioned to face the upper end portion 1425*a* of the second port coupling portion 1425.

Referring to FIGS. 17 to 19, the drain pump 600 may rotate in the direction R from the first position P1 to be located at the second position P2. While the drain pump 600 is located at the second position P1, the drain pump 600 may be fixed to the drain port 142. While the drain pump 600 is located at the second position P2, the drain pump 600 may be prevented from being separated from the drain port 142 in the direction of the rotation axis 600*a*. While the drain pump 600 is located at the second position P2, the drain pump 600 may be in a state of being correctly assembled with the drain port 142. In the drain pump 600 located at the second position P2, the first pump coupling portion 611 may be coupled to the first port coupling portion 1424, and the second pump coupling portion 6124 may be coupled to the second port coupling portion 1425. That is, the drain pump 600 located at the second position P2 may be in a state of being installed in the sump housing 100.

For example, the drain pump 600 may rotate to about 45 degrees substantially in a counterclockwise direction from the first position P1 to be located at the second position P2, although not limited thereto. However, a rotation direction and rotation range of the drain pump 600 may depend on shapes and positions of the pump coupling portions 611 and 612 and the port coupling portions 1424 and 1425.

Referring to FIG. 18, according to a rotation of the drain pump 600 from the first position P1, the first pump coupling portion 611 may be coupled to the first port coupling portion 1424. While the drain pump 600 is located at the second position P2, the first port coupling portion 1424 may be accommodated in the second groove 6112 of the first pump coupling portion 611. While the drain pump 600 is located at the second position P2, the end portion 1424*a* of the first port coupling portion 1424 may be accommodated in the second groove 6112 of the first pump coupling portion 611. While the drain pump 600 is located at the second position P2, the end portion 1424*a* of the first port coupling portion 1424 may be in contact with the stopper 6113.

Referring to FIG. 18, according to a rotation of the drain pump 600 from the first position P1, the second pump coupling portion 612 may be coupled to the second port coupling portion 1425. While the drain pump 600 is located at the second position P2, the second port coupling portion 1425 may be accommodated in the second groove 6122 of the second pump coupling portion 612. In a state in which the drain pump 600 is located at the second position P2, the end portion 1425*a* of the second port coupling portion 1425 may be accommodated in the second groove 6122 of the second pump coupling portion 612. In the state in which the drain pump 600 is located at the second position P2, the end portion 1425*a* of the second port coupling portion 1425 may be in contact with the stopper 6123.

For example, a case in which the end portion 1424*a* of the first port coupling portion 1424 is a lower end portion of the first port coupling portion 1424, and the end portion 1425*a* of the second port coupling portion 1425 is an upper end portion of the second port coupling portion 1425 is shown in the drawings. However, the disclosure is not limited to this case. On the contrary, the end portion 1424*a* of the first port coupling portion 1424 may be an upper end portion of the first port coupling portion 1424, and the end portion 1425*a* of the second port coupling portion 1425 may be a lower end portion of the second port coupling portion 1425. A rotation direction of the drain pump 600 may be an opposite direction of the direction R, the first pump coupling portion 611 may open downward, and the second pump coupling portion 612 may open upward.

Meanwhile, in a state in which the drain pump 600 is located at the second position P2, the interfering rib 613 may not interfere with the drain port 142. For example, the interfering rib 613 may be spaced from an uppermost end portion 142*t* of the drain port 142. That is, the drain pump 600 located at the first position P1 may rotate to the second position P2 without any interference.

Referring to FIG. 19, in the state in which the drain pump 600 is located at the second position P2, the sealing protrusion 640 may be in contact with an inner surface of the drain port 142. The sealing protrusion 640 may seal between the drain port 142 and the drain pump 600 to thereby prevent water from leaking out of the drain port 142.

An existing dishwasher includes at least three coupling portions for fixing a drain pump to a sump housing, or additionally includes a separate coupling member such as a screw.

For example, the dishwasher Ta according to the disclosure may include a first coupling portion for coupling the first pump coupling portion 611 to the first port coupling portion 1424 and a second coupling portion for coupling the second pump coupling portion 612 to the second port coupling portion 1425. That is, because the dishwasher 1*a* includes two coupling portions for fixing the drain pump 600 to the sump housing 100, a mold may be more easily manufactured. Also, because the first pump coupling portion 611 is coupled to the first port coupling portion 1424 and the second pump coupling portion 612 is coupled to the second port coupling portion 1425 according to a rotation in direction R of the drain pump 600, a separate coupling member may be not needed. Therefore, the drain pump 600 may be easily coupled to the drain port 142 with a more simplified configuration.

Figure 20:
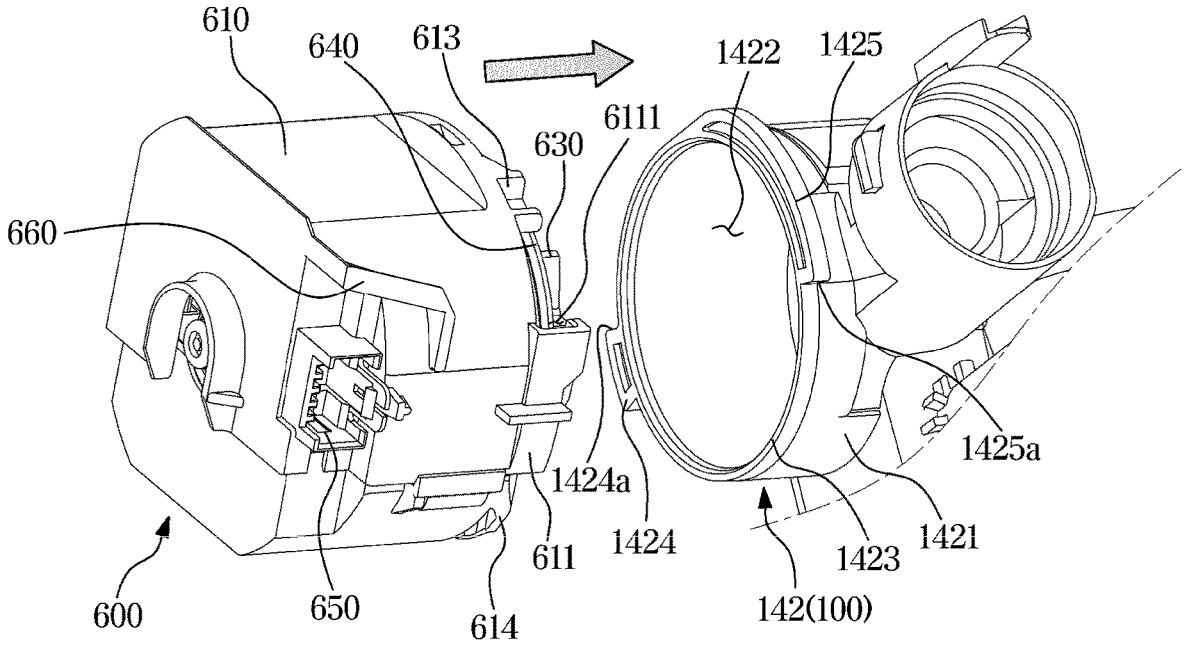
FIG. 20 shows an example of a state in which a drain pump according to an embodiment of the disclosure is arranged to be reversely assembled with a drain port.
Figure 21:
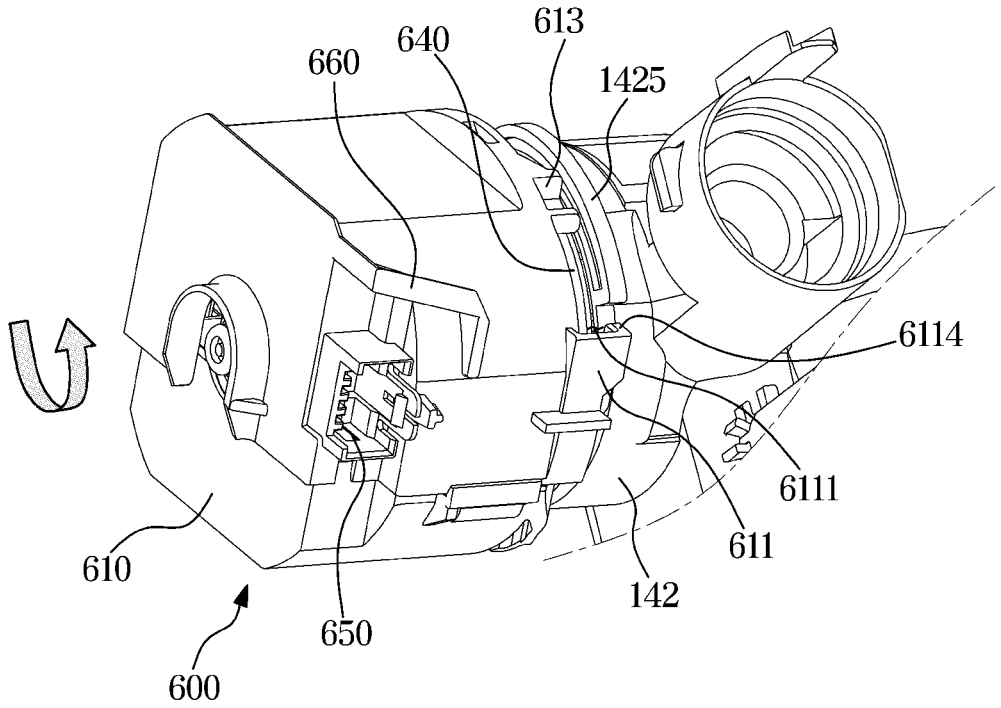
FIG. 21 shows a state in which a part of the drain pump shown in FIG. 20 is inserted in the drain port according to an embodiment of the disclosure.
Figure 22:
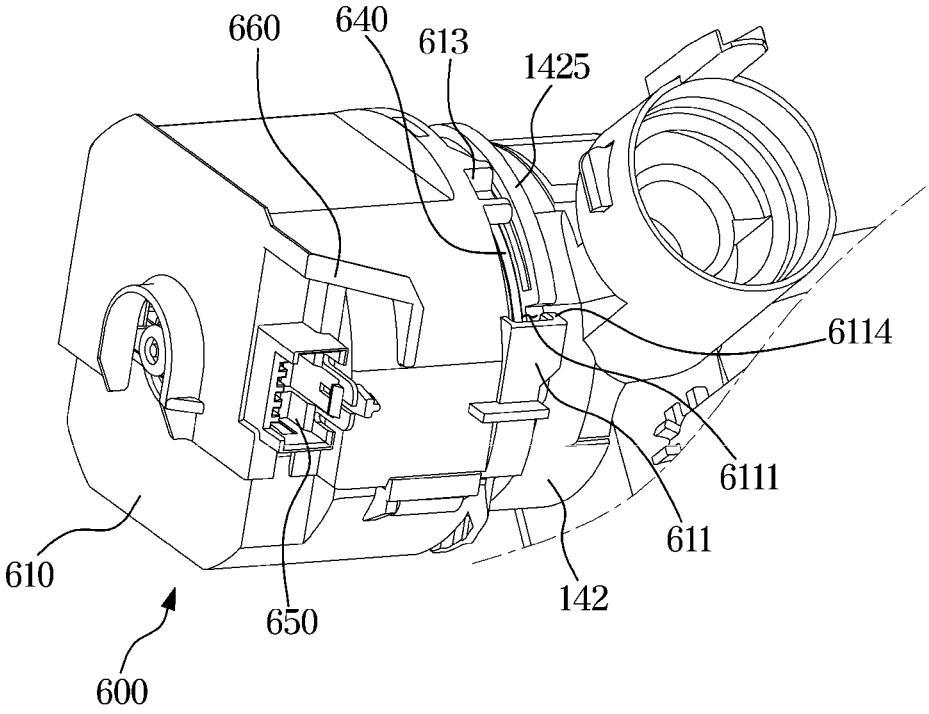
FIG. 22 shows a state in which the drain pump shown in FIG. 21 rotates according to an embodiment of the disclosure.
Figure 23:
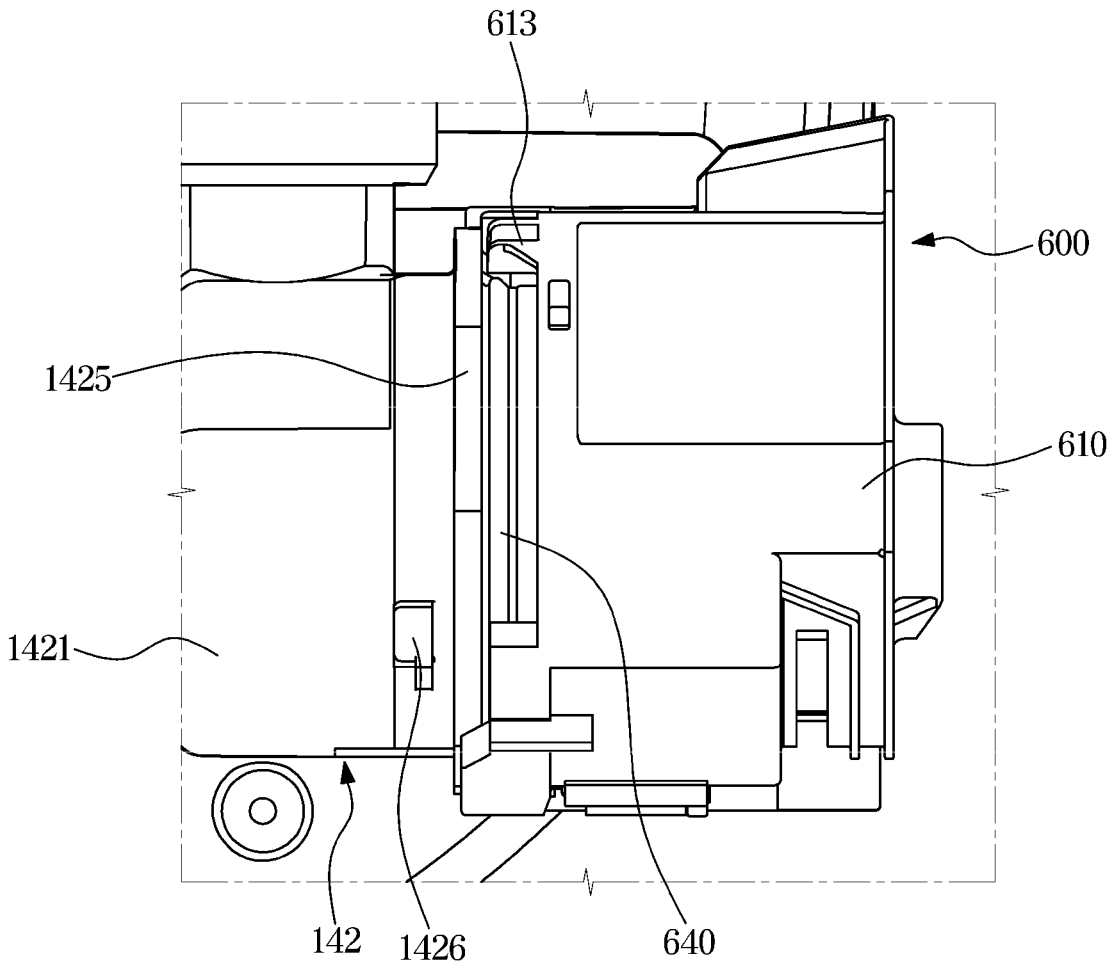
FIG. 23 shows the drain port and the drain pump shown in FIG. 22 according to an embodiment of the disclosure.

FIG. 20 shows an example of a state in which a drain pump according to an embodiment of the disclosure is arranged to be reversely assembled with a drain port. FIG. 21 shows a state in which a part of the drain pump shown in FIG. 20 is inserted in the drain port. FIG. 22 shows a state in which the drain pump shown in FIG. 21 rotates. FIG. 23 shows the drain port and the drain pump shown in FIG. 22.

An example of a process for preventing the drain pump 600 from being mis-assembled with respect to the drain port 142 will be described with reference to FIGS. 20 to 23.

Meanwhile, a worker, etc. may provide a service in a state in which the dishwasher 1*a* is reversely placed, as described above. FIGS. 20 to 23 may be views provided in view of a worker providing a service.

Referring to FIG. 20, the drain pump 600 may be arranged at a mis-assembling position with respect to the drain port 142. For example, the drain pump 600 may be placed in a state of being turned reversely with respect to a state (see FIG. 15) of being arranged at a correct assembling position.

Referring to FIG. 21, at least one portion of the drain pump 600 shown in FIG. 20 may be inserted in the drain port 142 in the direction of the rotation axis 600*a*. For example, the impeller 630 of the drain pump 600 may be located in the body space 1422 of the drain port 142.

At this time, the first pump coupling portion 611 may be in a state corresponding to the second port coupling portion 1425. The corresponding state may be a state in which the first pump coupling portion 611 opens toward the second port coupling portion 1425. For example, the first groove 6111 of the first pump coupling portion 611 may face the end portion 1425*a* of the second port coupling portion 1425.

Also, the second pump coupling portion 612 may be in a state corresponding to the first port coupling portion 1424. The corresponding state may be a state in which the second pump coupling portion 612 opens toward the first port coupling portion 1424. For example, the first groove 6121 of the second pump coupling portion 612 may face the end portion 1424*a* of the first port coupling portion 1424.

Referring to FIG. 22, the drain pump 600 shown in FIG. 21 may have difficulties in rotating in the direction R. That is, the drain pump 600 may have difficulties in rotating in the direction R in a state in which the first pump coupling portion 611 corresponds to the second port coupling portion 1425 and the second pump coupling portion 612 corresponds to the first port coupling portion 1424. Accordingly, the first pump coupling portion 611 may have difficulties in being coupled to the second port coupling portion 1425, and the second pump coupling portion 612 may have difficulties in being coupled to the first port coupling portion 1424. Assembling the drain pump 600 turned reversely with the drain port 142 may be limited.

Referring to FIGS. 22 and 23, the interfering rib 613 may interfere with the second port coupling portion 1425 in a state in which the drain pump 600 is wrongly arranged with respect to the drain port 142. For example, in the state in which the drain pump 600 is wrongly arranged with respect to the drain port 142, the interfering rib 613 may face the second port coupling portion 1425. That is, in the state in which the drain pump 600 is wrongly arranged with respect to the drain port 142, the second port coupling portion 1425 may be provided as a counterpart of the interring rib 613. For example, while the drain pump 600 is reversely assembled with the drain port 142, the second port coupling portion 1425 may be provided as a counterpart with respect to the interfering rib 613. Accordingly, the interfering rib 613 may be caught by the second port coupling portion 1425. A worker, etc. may easily identify mis-assembling of the drain pump 600 by recognizing that the interfering rib 613 is caught by the second port coupling portion 1425. As a result, the worker, etc. may correctly assemble the drain pump 600 with the drain port 142 without confusing an assembling direction of the drain pump 600. In other words, assembling performance of the drain pump 600 may be improved.

For example, in a state in which the first pump coupling portion 611 corresponds to the second port coupling portion 1425 and the second pump coupling portion 612 corresponds to the first port coupling portion 1424, the interfering rib 613 may interfere with the second port coupling portion 1425 of the drain port 142. For example, in the state in which the first pump coupling portion 611 corresponds to the second port coupling portion 1425 and the second pump coupling portion 612 corresponds to the first port coupling portion 1424, the interfering rib 613 may be in contact with the second port coupling portion 1425 of the drain port 142. For example, because the interring rib 613 is caught by the second port coupling portion 1425, the drain pump 600 may have difficulties in being inserted into the drain port 142 until the end in the direction of the rotation axis 600*a*. At this time, the sealing protrusion 640 of the drain pump 600 may be not accommodated in the body space 1422. In a case in which the drain pump 600 rotates with respect to the drain port 142 without being inserted into the drain port 142 until the end in the direction of the rotation axis 600, the guide wall 6114 of the first pump coupling portion 611 may interfere with the second port coupling portion 1425. Likewise, the guide wall 6124 of the second pump coupling portion 612 may interfere with the first port coupling portion 1424. Meanwhile, although a worker, etc. forcedly inserts the drain pump 600 into the drain port 142 until the end, the worker, etc. may identify that the drain pump 600 has been wrongly assembled with the drain port 142 by easily recognizing an interfered state of the interfering rib 613 with the drain port 142. For example, because the interfering rib 613 interferes with the second port coupling portion 1425 in a state in which the drain pump 600 is mis-assembled with the drain port 142, the drain pump 600 may have great difficulties in rotating with respect to the drain port 142. For example, the interfering rib 613 may change in shape by being pressed by the second port coupling portion 1425.

The existing dishwasher does not include a structure for preventing the drain pump from being mis-assembled with the sump housing. That is, the existing dishwasher may include no fool proof system. For example, the drain pump may be reversely assembled with the sump housing. In a case in which the drain port is not correctly assembled with the sump housing, washing performance of the dishwasher may significantly deteriorate, which may cause a quality issue. For example, water may leak between the drain pump and the sump housing. Also, an electric shock or a fire may occur due to the leakage of water.

In contrast, the dishwasher 1*a* according to the disclosure may have a structure for preventing the drain pump 600 from being wrongly assembled with the sump housing 100. That is, the dishwasher 1*a* may have a fool proof system. For example, the drain pump 600 may include the interfering rib 613 that may interfere with the drain port 142. Also, the second port coupling portion 1425 of the drain port 142 may be relatively longer than the first port coupling portion 1424. Accordingly, in a case in which the first pump coupling portion 611 is coupled to the second port coupling portion 1425 and the second pump coupling portion 612 is coupled to the first port coupling portion 1424, the interfering rib 613 may be in contact with the second port coupling portion 1425 extending to be relatively long. That is, a user, etc. who tries to forcedly couple the drain pump 600 to the drain port 142 upon mis-assembling of the drain pump 600 and the drain port 142 may have difficulties in coupling the first pump coupling portion 611 to the second port coupling portion 1425 and coupling the second pump coupling portion 612 to the first port coupling portion 1424, due to interference of the interfering rib 613 with the second port coupling portion 1425. In other words, the drain pump 600 may be not stably fixed to the drain port 142 in a state of being not arranged at a correct assembling position with respect to the drain port 142. That is, the drain pump 600 may be prevented from being reversely assembled with the drain port 142. As a result, water may be prevented from leaking between the drain pump 600 and the sump housing 100, and an electric shock or a fire accident may be prevented in advance. Also, the drain pump 600 may be correctly assembled with the drain port 142 regardless of a user's (worker's) skill, which results in an improvement of assembling performance of the drain pump 600.

Figure 24:
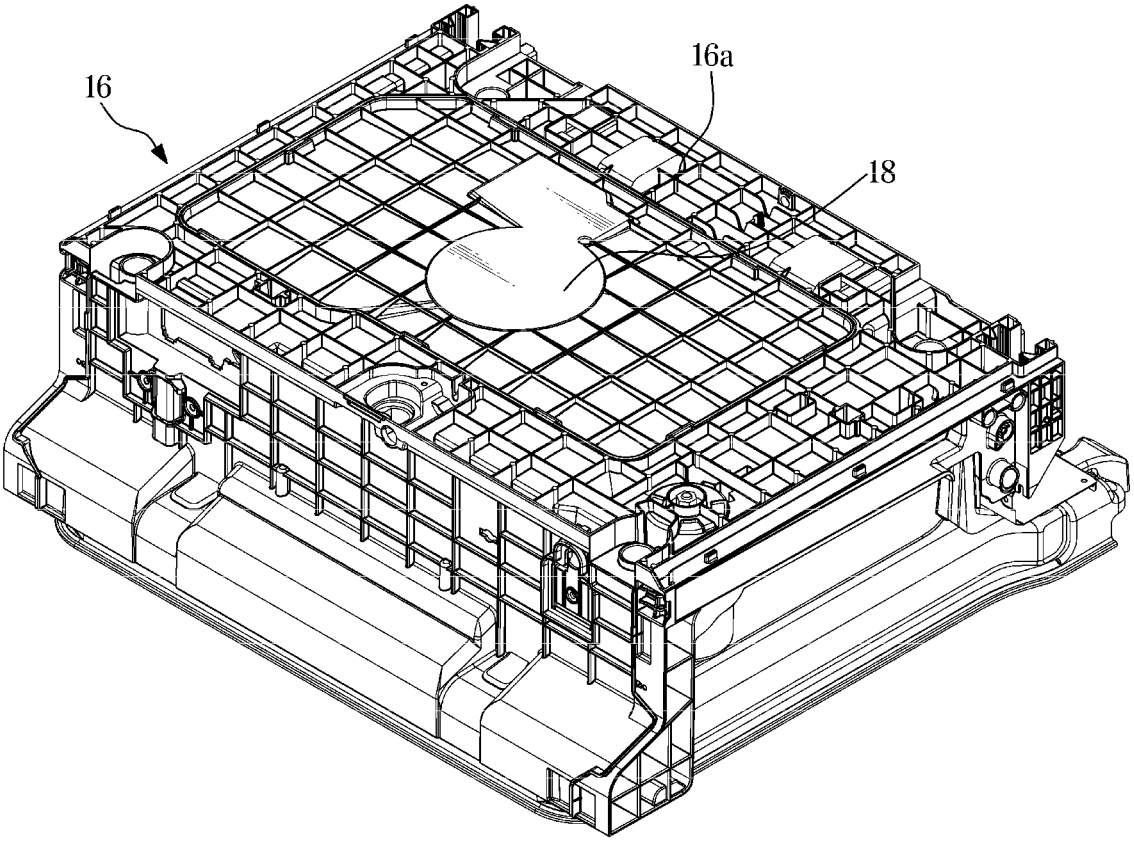
FIG. 24 is a schematic perspective view showing a portion of a dishwasher according to an embodiment of the disclosure.
Figure 25:
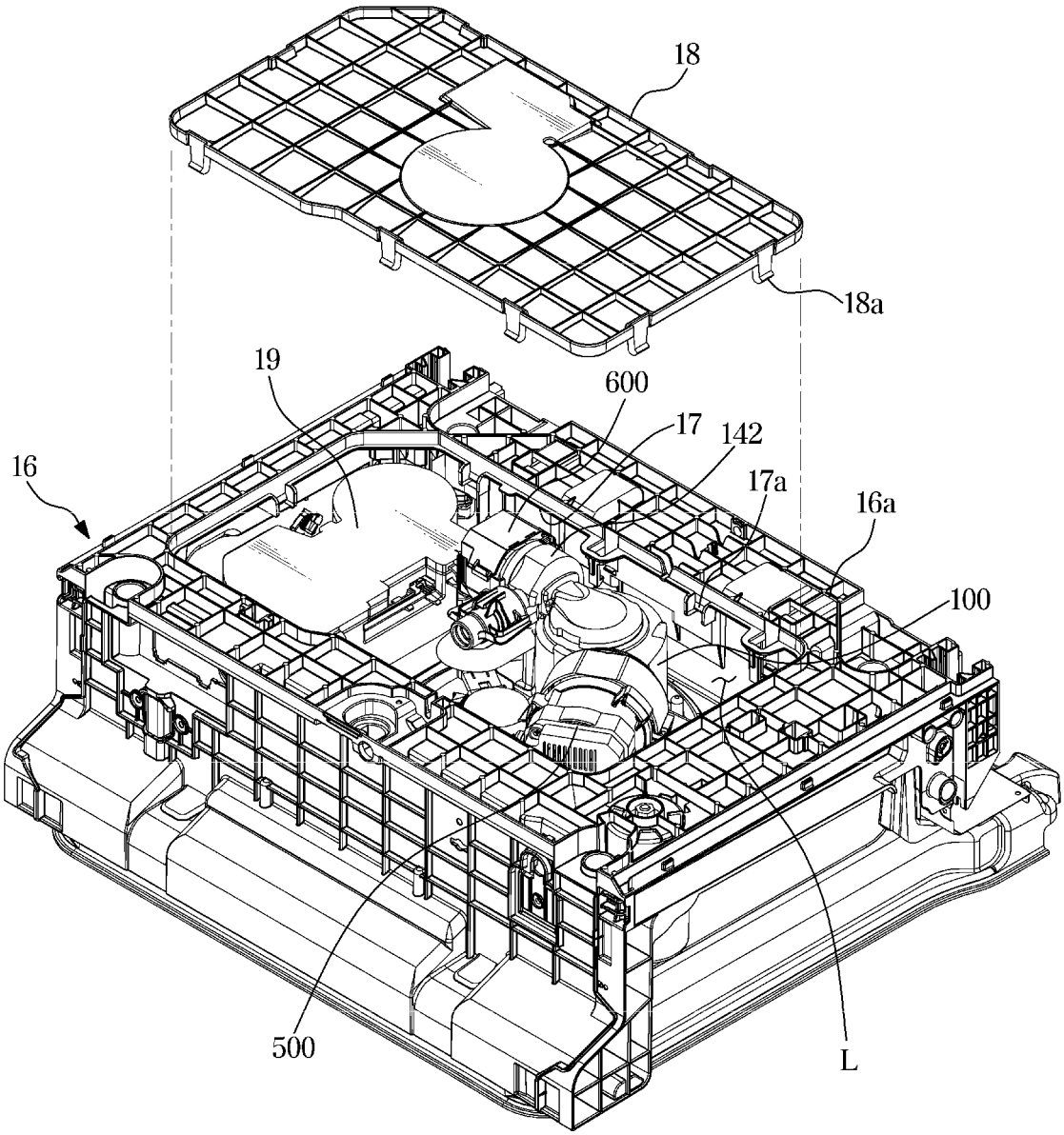
FIG. 25 is a perspective view showing a state in which a cover is separated from a base frame of the dishwasher shown in FIG. 24 according to an embodiment of the disclosure.
Figure 26:
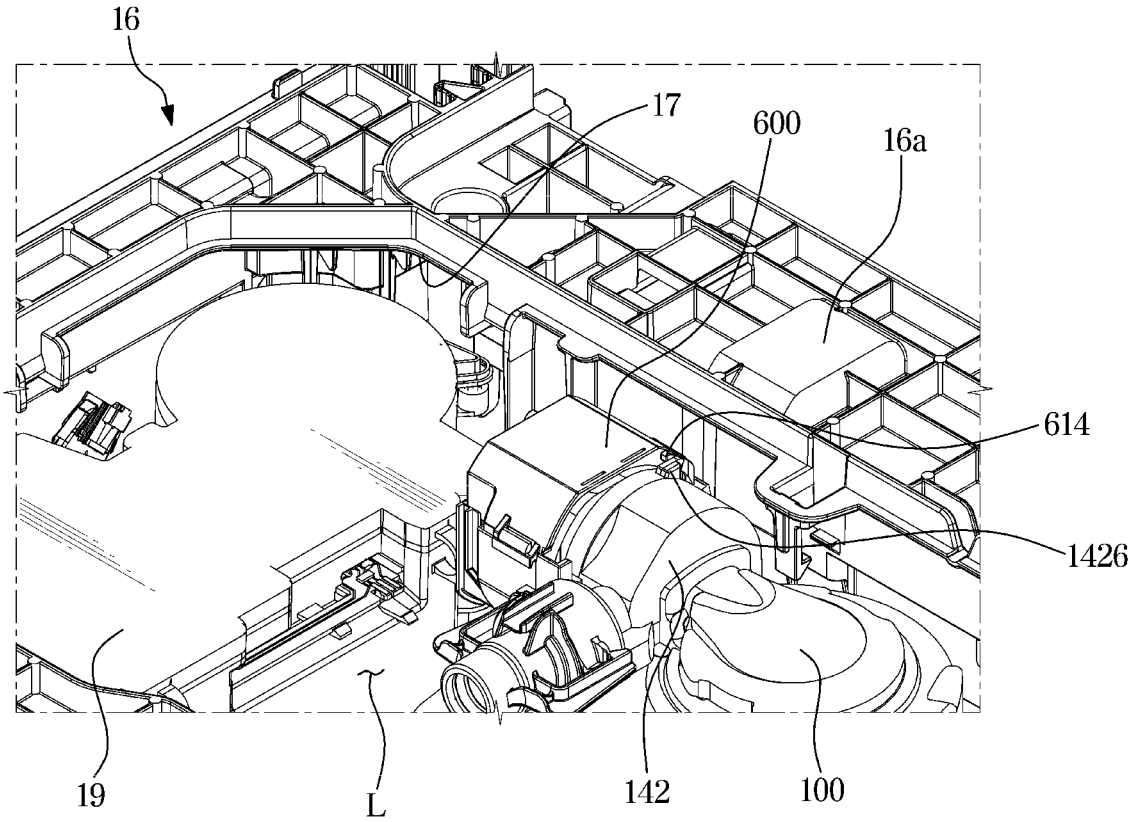
FIG. 26 is a perspective view showing a state in which the cover of the dishwasher shown in FIG. 25 is removed according to an embodiment of the disclosure.

FIG. 24 is a schematic perspective view showing a portion of a dishwasher according to an embodiment of the disclosure. FIG. 25 is a perspective view showing a state in which a cover is separated from a base frame of the dishwasher shown in FIG. 24. FIG. 26 is a perspective view showing a state in which the cover of the dishwasher shown in FIG. 25 is removed. FIG. 27 is an enlarged view of a part of FIG. 26.

Referring to FIGS. 24 to 27, the dishwasher 1*a* may include the base frame 16. The base frame 16 may form the machine room L provided below the washing room C. The base frame 16 may be positioned below the tub 12.

The base frame 16 may accommodate at least one portion of the sump assembly 70. For example, the base frame 16 may accommodate the sump housing 100, the drain pump 600, the circulation pump 500, and a water softener 19.

The dishwasher 1*a* may include an opening 17. The opening 17 may be formed in the bottom 16*a* of the base frame 16. The opening 17 may correspond to the drain pump 600. The opening 17 may enable an access to the drain pump 600. The opening 17 may enable an access to the hooking protrusion 614 of the drain pump 600, fixed to the locking portion 1426 of the drain port 142.

The dishwasher 1*a* may include a cover 18. The cover 18 may open and close the opening 17. The cover 18 may have a shape corresponding to a shape of the opening 17. For example, the cover 18 may include substantially a plate shape.

Referring to FIG. 25, the cover 18 may include a first installing portion 18*a*. The base frame 16 may include a second installing portion 17*a*. The first installing portion 18*a* may be detachably coupled to the second installing portion 17*a*. By coupling the first installing portion 18*a* to the second installing portion 17*a*, the cover 18 may cover the opening 17.

The first installing portion 18*a* may have a shape corresponding to the second installing portion 17*a*. For example, the first installing portion 18*a* may protrude toward the opening 17. For example, the second installing portion 17*a* may be provided around the opening 17 and have a depressed shape, although not limited thereto. However, the first installing portion 18 may have a depressed shape, and the second installing portion 17*a* may have a shape protruding toward the cover 18.

At least one or more first installing portions 18*a* may be provided. At least one or more second installing portions 17*a* may be provided.

For example, the user, etc. may access the drain pump 600 through the opening 17. The cover 18 may be disassembled from the base frame 16. In a case in which the cover 18 opens the opening 14, the drain pump 600 and the sump housing 100 may be exposed through the opening 17. Because the drain pump 600 and the sump housing 100 are exposed through the opening 17, the user, etc. may access the hooking protrusion 614 of the drain pump 600 and the locking portion 1426 of the drain port 142. The user, etc. may access the machine room L through the opening 17 to decouple the hooking protrusion 614 from the locking portion 1426. For example, the user, etc. may decouple the hooking protrusion 614 from the locking portion 1426 by pressing the hooking protrusion 614 (see an arrow of FIG. 17). Then, the user, etc. may locate the drain pump 600 from the second position P2 to the first position P1 by rotating the drain pump 600 in the opposite direction of the assembling direction R with respect to the drain port 142. As a result, the drain pump 600 may be disassembled from the drain port 142 along the direction of the rotation axis 600*a* at the first position P1.

Meanwhile, for example, an order in which the drain pump 600 is assembled may be a reverse order of an order in which the drain pump 600 is disassembled as described above.

In the existing dishwasher, a structure for causing the drain pump to be caught by the sump housing is positioned upward. For example, a locking portion is formed in an upper portion of the drain port, and a hooking protrusion to be caught by the locking portion is also positioned in the upper portion of the drain pump. However, in this case, while a user, etc. installs the drain pump in the drain port or separates the drain pump from the drain port, the structure may interfere with other components of the dishwasher. For example, the user, etc. may have difficulties in putting his/her hand toward the locking portion and the hooking protrusion. Also, in the case in which the hooking protrusion of the drain pump and the locking portion of the drain port are positioned upward, the hooking protrusion and the locking portion may be hidden by other components of the dishwasher, and accordingly, it may be not easy to check a coupling state of the hooking protrusion and the locking portion. Therefore, it may be not easy to maintain and repair the drain pump.

In contrast, in the dishwasher 1*a* according to the disclosure, a structure for causing the drain pump 600 to be caught by the sump housing 100 may be positioned downward. For example, the locking portion 1426 may be formed in the lower portion of the port body 1421 of the drain port 142. The locking portion 1426 may be positioned toward the bottom 16*a* of the base frame 16. The locking portion 1426 may protrude toward the bottom 16*a* of the base frame 16. For example, the lower portion of the port body 1421 may be an area below the first horizontal line H1 (see FIG. 9). The hooking protrusion 614 of the drain pump 600 may be positioned in the lower portion of the drain pump 600 to be caught by the locking portion 1426 formed in the lower portion of the port body 1421. By the arrangement, in a case in which the opening 17 opens, the hooking protrusion 164 and the locking portion 1426 may be exposed through the opening 17. Accordingly, the user, etc. may easily access the hooking protrusion 614 of the drain pump 600 and the locking portion 1426 of the drain port 142 through the opening 17. Also, because the hooking protrusion 614 of the drain pump 600 and the locking portion 1426 of the drain port 142 are not hidden by other components of the dishwasher 1*a*, a coupling state of the hooking protrusion 614 and the locking portion 1426 may be easily checked. As a result, the dishwasher 1*a* may easily maintain and repair the drain pump 600.

FIG. 28 is a schematic side cross-sectional view of a dishwasher according to an embodiment of the disclosure.

FIG. 28 shows an example of a front loading washing machine T a having an inlet in a front side, although the disclosure is not limited thereto. For example, the washing machine 1*b* may be a top loading washing machine having an inlet in an upper side. However, a kind of the washing machine 1*b* is not limited. A drain assembly according to the disclosure may be applied to various types of washing machines.

Referring to FIG. 28, the washing machine 1*b* may include a cabinet 2 forming an outer appearance, a tub 3 positioned inside the cabinet 2, a drum 4 rotatably positioned inside the tub 3, and a driving motor 5 for driving the drum 4. Meanwhile, the cabinet 2 may also be referred to as a main body 2.

In a front side of the cabinet 2, an inlet 7 for enabling a user to put laundry into the drum 4 may be formed. The inlet 7 may be opened and closed by a door 8 mounted on the front side of the cabinet 2.

The drum 4 may include a plurality of through holes 4*a* for passing water through. The drum 4 may include a plurality of lifters 4*b* for raising and dropping laundry while rotating.

The drum 4 may be connected to the driving motor 5 through a connecting portion 6. The connecting portion 6 may transfer a driving force generated by the driving motor 5 to the drum 4. For example, the connecting portion 6 may include a shaft, a pulley, a belt, etc.

The washing machine 1*b* may include a drain assembly. The drain assembly may include a drain port 142 and a drain pump 600. For example, the tub 3 may be connected to the drain port 142 by a connecting hose 9, although not limited thereto. However, the drain port 142 may be connected directly to the tub 3. Alternatively, the drain port 142 may be provided as a component of the tub 3.

The drain assembly may discharge water stored in the tub 3 to outside of the cabinet 2. The drain assembly may include the drain port 142 communicating with the tub 3, and the drain pump 600 detachably coupled to the drain port 142 to generate a pumping force. By the pumping force of the drain pump 600, water stored inside the tub 3 may be discharged to the outside of the cabinet 2 through a drain pipe 22. The drain assembly of the washing machine 1*b* is the same as the drain assembly of the dishwasher 1*a* descried above, and accordingly, a detailed description thereof will be omitted.

Meanwhile, the washing machine 1*b* may further include an opening (not shown) formed in a bottom of the cabinet 2 to allow an access to the drain assembly. Also, the washing machine 1*b* may further include a cover (not shown) for opening and closing the opening. To provide a service of the washing machine, a worker, etc. may open the cover formed in the bottom of the cabinet 2 to maintain and repair the drain assembly. The opening of the washing machine 1*b* may be the same as the opening 17 of the dishwasher Ta described above. The cover of the washing machine 1*b* may be the same as the cover 18 of the dishwasher 1*a* described above. The worker, etc. may easily access the hooking protrusion 614 and the locking portion 1426 of the drain assembly through the opening.

Because the washing machine 1*b* includes the drain assembly having an improved structure, mis-assembling of the drain pump 600 may be prevented. Because the washing machine 1*b* includes the drain assembly having the improved structure, the drain pump 600 may be easily assembled and/or disassembled. Because the washing machine 1*b* includes the drain assembly having the improved structure, the drain pump 600 may be easily maintained and repaired.

So far, specific embodiments have been shown and described, however, the disclosure is not limited to these embodiments. It should be interpreted that various modifications may be made by one of ordinary skill in the technical art to which the disclosure belongs, without deviating from the gist of the technical concept of the disclosure, which is defined in the following claims.

What is claimed is:

1. A dishwasher comprising:

a tub forming a washing room;

a drain port including:

a port body, a first port coupling portion extending along an edge of an outer circumferential surface of the port body, and a second port coupling portion extending along the edge of the outer circumferential surface of the port body, the second port coupling portion having a length longer than a length of the first port coupling portion, a drain pump configured to be insertable into the drain port and rotatable in a circumferential direction to be coupleable to and decouplable from the drain port, and while the drain pump is coupled to the drain port, to generate a pumping force to drain water from the washing room of the tub that flows through the drain port to an outside of the dishwasher, the drain pump including:

a first pump coupling portion configured to couple to and decouple from the first port coupling portion of the drain port;

a second pump coupling portion configured to couple to and decouple from the second port coupling portion of the drain port; and an interfering rib formed to protrude toward the drain port, wherein, as the drain pump is inserted into the drain port in a state in which the interfering rib interferes with the second port coupling portion of the drain port and is rotated, the interfering rib interferes with the second port coupling portion of the drain port to restrict rotation of the drain pump, thereby preventing the first pump coupling portion of the drain pump from being coupled to the second port coupling portion of the drain port or preventing the second pump coupling portion of the drain pump from being coupled to the first port coupling portion of the drain port.

2. The dishwasher of claim 1, wherein the first pump coupling portion of the drain pump is configured to rotate along a circumferential direction of and outside an edge surface of the first port coupling portion of the drain port, and the second pump coupling portion of the drain pump is configured to rotate along the circumferential direction of and outside an edge surface of the second port coupling portion of the drain port.

3. The dishwasher of claim 1, wherein the first pump coupling portion of the drain pump and the second pump coupling portion of the drain pump are in a shape of point symmetry with respect to a rotation axis of the drain pump.

4. The dishwasher of claim 1, wherein the drain pump is coupled to the drain port by rotating the first pump coupling portion of the drain pump in one direction along an edge of the first port coupling portion of the drain port and rotating the second pump coupling portion of the drain pump in the one direction along an edge of the second port coupling portion of the drain port.

5. The dishwasher of claim 4, wherein the drain pump comprises:

a first stopper configured to be in contact with the first port coupling portion of the drain port, in a state in which the drain pump is coupled to the drain port, and limit a rotation of the first pump coupling portion of the drain pump in the one direction; and a second stopper configured to be in contact with the second port coupling portion of the drain port, in the state in which the drain pump is coupled to the drain port, and limit a rotation of the second pump coupling portion of the drain pump in the one direction.

6. The dishwasher of claim 1, wherein the drain pump is movable between a first position at which the drain pump is inserted in the drain port and a second position at which the drain pump is coupled to the drain port by rotating in one direction while the drain pump is at the first position.

7. The dishwasher of claim 6, wherein the drain port further comprises a locking portion formed in a lower portion of the port body, and the drain pump further comprises a hooking protrusion in contact with the locking portion in a state in which the drain pump is located at the second position.

8. The dishwasher of claim 7, further comprising:

a base frame positioned below the tub and configured to accommodate the drain port and the drain pump;

an opening formed at a bottom of the base frame; and a cover configured to open and close the opening.

9. The dishwasher of claim 8, wherein the opening allows the hooking protrusion of the drain pump and the locking portion of the drain port to be accessed through the opening.

10. The dishwasher of claim 8, wherein the locking portion of the drain port is positioned toward the bottom of the base frame.

11. The dishwasher of claim 6, wherein the first pump coupling portion of the drain pump comprises:

a first groove open toward an end of the first port coupling portion of the drain port in a state in which the drain pump is located at the first position, a width of the first groove being a first width; and a second groove extending from the first groove and to accommodate the first port coupling portion of the drain port in a state in which the drain pump is located at the second position, a width of the second groove being a second width that is smaller than the first width.

12. The dishwasher of claim 6, wherein the second pump coupling portion of the drain pump comprises:

a first groove open toward an end of the second port coupling portion of the drain port in a state in which the drain pump is located at the first position, a width of the first groove being a first width; and a second groove extending from the first groove and to accommodate the second port coupling portion of the drain port in a state in which the drain pump is located at the second position, a width of the second groove being a second width that is smaller than the first width.

13. The dishwasher of claim 6, wherein, while the drain pump is located at the second position, the interfering rib is located above the first pump coupling portion of the drain pump and the second pump coupling portion of the drain pump.

14. The dishwasher of claim 7, wherein, while the drain pump is located at the second position, the hooking protrusion is located below the first pump coupling portion of the drain pump and the second pump coupling portion of the drain pump.

15. The dishwasher of claim 1, wherein the drain pump comprises:

a drain motor;

an impeller connectable to the drain motor and configured to rotate; and a case to accommodate the drain motor, the case including the first pump coupling portion of the drain pump, the second pump coupling portion of the drain pump, and the interfering rib.

* * * * *